US010094112B1

(12) United States Patent
Dupray

(10) Patent No.: US 10,094,112 B1
(45) **Date of Patent: *Oct. 9, 2018**

(54) STAY-IN-PLACE INSULATED CONCRETE FORMING SYSTEM

(71) Applicant: Dennis J. Dupray, Golden, CO (US)

(72) Inventor: Dennis J. Dupray, Golden, CO (US)

(73) Assignee: Dennis J. Dupray, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/479,248

(22) Filed: Apr. 4, 2017

Related U.S. Application Data

(60) Continuation of application No. 14/583,615, filed on Dec. 27, 2014, now Pat. No. 9,611,645, which is a division of application No. 13/844,791, filed on Mar. 16, 2013, now Pat. No. 8,919,057.

(60) Provisional application No. 61/652,316, filed on May 28, 2012.

(51) Int. Cl.

| | |
|---|---|
| ***E04C 2/06*** | (2006.01) |
| ***E04C 2/04*** | (2006.01) |
| ***E04C 2/08*** | (2006.01) |
| ***E04C 5/08*** | (2006.01) |

(52) U.S. Cl.
CPC ..... *E04C 2/06* (2013.01); *E04C 2/044* (2013.01); *E04C 5/08* (2013.01)

(58) Field of Classification Search
CPC ..... E04C 2/06; E04C 5/08; E04C 2/044
See application file for complete search history.

(56) References Cited

U.S. PATENT DOCUMENTS

| | | | | |
|---|---|---|---|---|
| 2,299,670 | A | 10/1942 | Westcott | |
| 3,137,971 | A | 6/1964 | Rhodes | |
| 3,214,034 | A * | 10/1965 | Cheek | G01G 19/04 177/134 |
| 3,237,357 | A | 3/1966 | Hutchings | |
| 3,540,359 | A * | 11/1970 | Swisher, Jr. | E01C 19/185 198/861.1 |
| 3,693,310 | A | 9/1972 | Middleton | |
| 3,944,242 | A | 3/1976 | Eubank | |
| 4,166,347 | A | 9/1979 | Pohlman et al. | |
| 4,574,545 | A | 3/1986 | Reigstad et al. | |
| 4,911,582 | A | 3/1990 | Peirce, Jr. et al. | |
| 4,942,364 | A | 7/1990 | Nishijima et al. | |
| 5,025,605 | A | 6/1991 | Sekijima et al. | |
| 5,365,779 | A | 11/1994 | VanderVelde | |
| 6,119,417 | A | 9/2000 | Valverde et al. | |
| 6,311,564 | B1 * | 11/2001 | Martin | G01B 7/18 73/787 |
| 6,321,657 | B1 * | 11/2001 | Owen | B61B 1/02 104/119 |

(Continued)

FOREIGN PATENT DOCUMENTS

| | | |
|---|---|---|
| EP | 0297006 | 5/1992 |
| GB | 943852 | 12/1963 |
| GB | 1260176 | 1/1972 |

OTHER PUBLICATIONS

AmDeck™ Technical & Installation Manual: amvic building system, Revision 1.00, Amvic, Inc., 2007, 103 pages.

(Continued)

*Primary Examiner* — Jeanette E Chapman
(74) *Attorney, Agent, or Firm* — AspireIP

(57) ABSTRACT

A method of tensioning concrete is disclosed.

18 Claims, 19 Drawing Sheets

(56) References Cited

U.S. PATENT DOCUMENTS

| | | | | |
|---|---|---|---|---|
| 6,471,299 | B2 | 10/2002 | Brooks et al. | |
| 6,832,454 | B1 | 12/2004 | Iyer | |
| 7,339,489 | B2 | 3/2008 | Arita et al. | |
| 7,596,915 | B2 | 10/2009 | Lee et al. | |
| 7,637,166 | B2 | 12/2009 | Hecht et al. | |
| 8,020,235 | B2 | 9/2011 | Grace | |
| 8,091,432 | B2 | 1/2012 | Hecht et al. | |
| 8,109,691 | B2 | 2/2012 | Clark | |
| 8,919,057 | B1 | 12/2014 | Dupray | |
| 9,611,645 | B1 | 4/2017 | Dupray | |
| 9,784,627 | B2 * | 10/2017 | Saito | G01L 1/125 |
| 2004/0130063 | A1 | 7/2004 | Ohta | |
| 2004/0206032 | A1 | 10/2004 | Messenger et al. | |
| 2006/0117833 | A1 | 6/2006 | Kanare | |
| 2006/0201100 | A1 | 9/2006 | Langwadt et al. | |
| 2006/0230696 | A1 | 10/2006 | Sarkkinen | |
| 2007/0046479 | A1 | 3/2007 | Hines | |
| 2007/0058898 | A1 | 3/2007 | Slade et al. | |
| 2007/0126433 | A1 | 6/2007 | Theophanous et al. | |
| 2008/0121151 | A1 | 5/2008 | Hallissy et al. | |
| 2010/0095603 | A1 * | 4/2010 | DeFilipp | E02D 27/42 52/1 |
| 2010/0199972 | A1 * | 8/2010 | Brost | F24J 2/1052 126/601 |
| 2010/0315076 | A1 * | 12/2010 | Tsukada | G01L 5/102 324/209 |
| 2011/0138549 | A1 | 6/2011 | He | |
| 2011/0277547 | A1 | 11/2011 | Duncan | |
| 2012/0204978 | A1 * | 8/2012 | Ozamiz Fortis | B65D 90/48 137/552 |
| 2013/0140509 | A1 * | 6/2013 | Domage | E04G 21/12 254/228 |
| 2013/0154441 | A1 | 6/2013 | Redmond | |
| 2015/0146760 | A1 | 5/2015 | Huang et al. | |
| 2015/0246614 | A1 | 9/2015 | Dames et al. | |
| 2015/0276233 | A1 | 10/2015 | Berchtold | |
| 2015/0285522 | A1 | 10/2015 | Berchtold | |
| 2015/0308697 | A1 | 10/2015 | Berchtold | |

OTHER PUBLICATIONS

Amvic Technical Manual, Revision 1.0, Amvic, Inc., Mar. 2006, 222 pages.

Estimating Guide for INSUL-DECK and Plastbau Technology, INSUL-DECK LLC, 2003, 40 pages.

Grace et al., "Full-Scale Test of Prestressed Double-Tee Beam," Concrete International, Apr. 2003, pp. 52-58.

Grace, "Strengthening of Negative Moment Region of Reinforced Concrete Beams Using Carbon Fiber-Reinforced Polymer Strips," ACI Structural Journal, May-Jun. 2001, Title No. 98-X33, pp. 347-358.

LITE-DECK Concrete Roofs/Floors/Walls: Technical Evaluation Manual, Nov. 2008, 46 pages.

Prestressed Concrete, Wikipedia, the free encyclopedia, accessed May 27, 2012, 5 pages.

PTData for Windows, Post-Tensioning Design and Analysis Program, Theory Manual, Structural Data Incorporated, 2000, 143 pages.

Stevenson et al., "Post-Tensioned Concrete Walls and Frames for Seismic-Resistance—A Case Study of the David Brower Center," SEAOC 2008 Convention Proceedings, 2008, pp. 1-8.

Website for Belfast Valley Contractors, http://www.belfastvalley.com/services/index.html, accessed May 19, 2012, 4 pages.

Website for LiteForm Technologies, http://www.theform.com/Lite_Deck/information.html, accessed May 19, 2012, 2 pages.

Official Action for U.S. Appl. No. 13/844,791, dated Oct. 22, 2013.

Official Action for U.S. Appl. No. 13/844,791, dated May 1, 2014.

Notice of Allowance for U.S. Appl. No. 13/844,791, dated Aug. 20, 2014.

Official Action for U.S. Appl. No. 14/583,615, dated Jul. 28, 2015.

Official Action for U.S. Appl. No. 14/583,615, dated Dec. 17, 2015.

Official Action for U.S. Appl. No. 14/583,615, dated Jul. 28, 2016.

Notice of Allowance for U.S. Appl. No. 14/583,615, dated Nov. 16, 2016.

* cited by examiner

| ANCHOR | A | B | C |
|---|---|---|---|
| SURELOCK | 5" | 2 1/4" | 1 1/2" |

STAY-IN-PLACE INSULATED CONCRETE FORMING SYSTEM

RELATED APPLICATION

The present application is a continuation of U.S. patent application Ser. No. 14/583,615, filed Dec. 27, 2014, which is a divisional application of U.S. patent application Ser. No. 13/844,791, filed Mar. 16, 2013, which claims the benefit of U.S. Provisional Patent Application 61/652,316, filed May 28, 2012; all of the above-identified applications being fully incorporated herein by reference.

RELATED FIELD OF THE INVENTION

The present application is directed to a method and system for tensioning concrete.

BACKGROUND

Prestressed Concrete

Prestressed concrete is a method for overcoming concrete's natural weakness in tension. It can be used to produce beams, floors or bridges with a longer span than is practical with ordinary reinforced concrete. Prestressing tendons (generally of high tensile steel cable or rods) are used to provide a clamping load which produces a compressive stress that balances the tensile stress that the concrete compression member would otherwise experience due to a bending load. Traditional reinforced concrete is based on the use of steel reinforcement bars, rebars, inside poured concrete. Prestressing can be accomplished in three ways: pre-tensioned concrete, and bonded or unbonded post-tensioned concrete.

Bonded Post-Tensioned Concrete

Bonded post-tensioned concrete is the descriptive term for a method of applying compression after pouring concrete and the curing process (in situ). The concrete is cast around a plastic, steel or aluminum curved duct, to follow the area where otherwise tension would occur in the concrete element. A set of tendons are fished through the duct and the concrete is poured. Once the concrete has hardened, the tendons are tensioned by hydraulic jacks that react (push) against the concrete member itself. When the tendons have stretched sufficiently, according to the design specifications (see Hooke's law), they are wedged in position and maintain tension after the jacks are removed, transferring pressure to the concrete. The duct is then grouted to protect the tendons from corrosion. This method is commonly used to create monolithic slabs for house construction in locations where expansive soils (such as adobe clay) create problems for the typical perimeter foundation. All stresses from seasonal expansion and contraction of the underlying soil are taken into the entire tensioned slab, which supports the building without significant flexure. Post-tensioning is also used in the construction of various bridges, both after concrete is cured after support by falsework and by the assembly of prefabricated sections, as in the segmental bridge.

Among the advantages of this system over unbonded post-tensioning are:

- Large reduction in traditional reinforcement requirements as tendons cannot destress in accidents.
- Tendons can be easily "woven" allowing a more efficient design approach.
- Higher ultimate strength due to bond generated between the strand and concrete.

- No long term issues with maintaining the integrity of the anchor/dead end.

History of Problems with Bonded Post-Tensioned Bridges

The popularity of this form of prestressing for bridge construction in Europe increased significantly around the 1950s and 60s. However, a history of problems have been encountered that has cast doubt over the long-term durability of such structures.

Due to poor workmanship of quality control during construction, sometimes the ducts containing the prestressing tendons are not fully filled, leaving voids in the grout where the steel is not protected from corrosion. The situation is exacerbated if water and chloride (from de-icing salts) from the highway are able to penetrate into these voids.

Notable events are listed below:

- The Ynys-y-Gwas bridge in West Glamorgan, Wales—a segmental post-tensioned structure, particularly vulnerable to defects in the post-tensioning system—collapsed without warning in 1984.
- The Melle bridge, constructed in Belgium during the 1950s, collapsed in 1992 due to failure of post-tensioned tie down members following tendon corrosion.
- Following discovery of tendon corrosion in several bridges in England, the Highways Agency issued a moratorium on the construction of new internal grouted post-tensioned bridges and embarked on a 5-year programme of inspections on its existing post-tensioned bridge stock.
- In 2000, a large number of people were injured when a section of a footbridge at the Charlotte Motor Speedway, USA, gave way and dropped to the ground. In this case, corrosion was exacerbated by calcium chloride that had been used as a concrete admixture, rather than sodium chloride from de-icing salts.
- In 2011, the Hammersmith Flyover in London, England, was subject to an emergency closure after defects in the post-tensioning system were discovered.

Unbonded Post-Tensioned Concrete

Unbonded post-tensioned concrete differs from bonded post-tensioning by providing each individual cable permanent freedom of movement relative to the concrete. To achieve this, each individual tendon is coated with a grease (generally lithium based) and covered by a plastic sheathing formed in an extrusion process. The transfer of tension to the concrete is achieved by the steel cable acting against steel anchors embedded in the perimeter of the slab. The main disadvantage over bonded post-tensioning is the fact that a cable can destress itself and burst out of the slab if damaged (such as during repair on the slab). The advantages of this system over bonded post-tensioning are:

1. The ability to individually adjust cables based on poor field conditions (For example: shifting a group of 4 cables around an opening by placing 2 to either side).
2. The procedure of post-stress grouting is eliminated.
3. The ability to de-stress the tendons before attempting repair work.

In one method of providing unbounded post-tensioned concrete, the holding end anchors are fastened to rebar placed above and below the cable and buried in the concrete locking that end. Rebar is placed above and below the cable both in front and behind the face of the pulling end anchor. The plastic sheathing surrounding each cable is stripped from the ends of the post-tensioning cables before placement through the pulling end anchors. After the concrete floor has been poured and has set for about a week, the cable ends will be pulled with a hydraulic jack.

Applications

Prestressed concrete is the main material for floors in high-rise buildings and the entire containment vessels of nuclear reactors.

Unbonded post-tensioning tendons are commonly used in parking garages as barrier cable. Also, due to its ability to be stressed and then de-stressed, it can be used to temporarily repair a damaged building by holding up a damaged wall or floor until permanent repairs can be made.

The advantages of prestressed concrete include crack control and lower construction costs; thinner slabs—especially important in high rise buildings in which floor thickness savings can translate into additional floors for the same (or lower) cost and fewer joints, since the distance that can be spanned by post-tensioned slabs exceeds that of reinforced constructions with the same thickness. Increasing span lengths increases the usable unencumbered floorspace in buildings; diminishing the number of joints leads to lower maintenance costs over the design life of a building, since joints are the major focus of weakness in concrete buildings.

The first prestressed concrete bridge in North America was the Walnut Lane Memorial Bridge in Philadelphia, Pa. It was completed and opened to traffic in 1951. Prestressing can also be accomplished on circular concrete pipes used for water transmission. High tensile strength steel wire is helically-wrapped around the outside of the pipe under controlled tension and spacing which induces a circumferential compressive stress in the core concrete. This enables the pipe to handle high internal pressures and the effects of external earth and traffic loads.

Design Agencies and Regulations

In the United States, pre-stressed concrete design and construction is aided by organizations such as Post-Tensioning Institute (PTI) and Precast/Prestressed Concrete Institute (PCI). In Canada the Canadian Precast/prestressed concrete Institute assumes this role for both post-tensioned and pre-tensioned concrete structures.

Europe also has its own associations and institutes. It is important to note that these organizations are not the authorities of building codes or standards, but rather exist to promote the understanding and development of pre-stressed design, codes and best practices. In the UK, the Post-Tensioning Association fulfills this role.[5]

Rules for the detailing of reinforcement and prestressing tendons are provided in Section 8 of the European standard EN 1992-2:2005—Eurocode 2: Design of concrete structures—Concrete bridges: design and detailing rules.

In Australia the code of practice used to design reinforced and prestressed concrete is AS 3600-2009.

SUMMARY

A stay-in-place insulated concrete forming system ("T-panel system" herein) for cast-in-place concrete floors, decks, balconies and roofs is disclosed herein. The T-panel system is designed to work with any of the many ICF (Insulated Concrete Forms) building products, currently available on the market, for fabricating, e.g., walls and/or floors.

In one embodiment, insulative panels or blocks for the T-panel system are produced by the steps of: (a) molding low-cost, recycled raw EPS (Expanded Polystyrene) into a sheets, e.g., 24" wide with a thickness of 12", and (b) combining such EPS panels with various concrete beams and steel beams to provide a building structural member ("composite structure" herein) such as a floor, much more cost effectively than prior art comparable structures having concrete structural members. In particular, the new composite structures (and their method of fabrication) disclosed herein provides an alternative for fabricating conventional wood floors, decks and roof applications in homes, townhouses, apartment buildings and commercial structures.

In addition to the T-panel system disclosed herein keeping the cost of fabrication at or below conventional (wood frame) construction prices, the resulting composite structures exceed the insulation characteristics (R-values) found in traditional residential and commercial construction standards. Accordingly, the T-panel system disclosed herein greatly reduces energy consumption of the resulting fabricated buildings.

Embodiments disclosed herein utilize stay-in-place panels or blocks of insulative material that may be made substantially of, e.g., recycled plastic (e.g., Expanded Polystyrene (EPS)) as described hereinbelow (each such insulative panel or block herein referred to as a concrete form/insulation panel or "CFI panel"). For example, such CFI panels may have an R value 50 or more.

The system and method disclosed herein may be used to construct concrete floors, roofs, decks for commercial, industrial and residential uses. The system and method disclosed herein results in a fabricated composite structure which is a combination of an insulative material (of, e.g., a recycled plastic) and reinforced post tensioned concrete structural members, wherein the structural strength of the resulting composite structure is substantially obtained from the reinforced concrete, and wherein the insulation properties are obtain from the insulative material.

The presently disclosed T-panel system (i.e., the method for fabricating the composite structures as well as the composite structures themselves) can also be used to provide ceiling and/or roof configurations that are sloped or gabled such as for vaulted room designs.

The fabricated composite structure of the presently disclosed T-panel system also provides enhanced insulation properties via the thermal mass properties of a concrete slab (in one embodiment, such concrete being 3" thick) combined with the attached CFI panels. In particular, such reinforced concrete structural members function to retain heat (e.g., solar heat). By using the proper ratio of thermal mass thickness to glazing (e.g., a ratio in the range of 6:1), the envelope of a building fabricated using the T-panel system will have reduced heating requirements during the cooler seasons as well as reduced air conditioning requirements during the hot seasons. In one embodiment, the thermal mass thickness of the structural members preferably may be between 2 to 4 inches for desirable daily cycles of, e.g., daytime (solar or building internal) heat absorption and heat release. Accordingly, in one preferred embodiment, a floor, ceiling, etc. fabricated according to the T-panel system may include post tensioned concrete structural members overlaid with a concrete slab approximately three inches in thickness.

In one embodiment, the concrete for the post tensioned concrete structural members (e.g., post tensioned concrete beams) is poured on top of the CFI panels and temporary support beams (e.g., composed of steel, wood or other material), wherein the temporary support beams may be received in channels or slots within the CFI panels for, e.g., supporting the composite structure until the concrete of the concrete beams are sufficiently cured (and post tensioned) for bearing the composite structure's intended loads.

In one embodiment, in order to reduce fabrication costs, the composite structural members of a composite structure may span clearly (e.g., without intermediate support when fully fabricated and cured) between support members (e.g., between two walls of a building or other structures) of lengths of 120 feet or more.

In one embodiment, the T-panel system for fabricating the composite structures described herein may use 270 Ksi (modulus of elasticity), low relaxation 7 strand steel cables (or other cabling having similar tensioning properties as described hereinbelow) for fabricating such composite structures. In particular, such cables are embedded in the one or more concrete of concrete beams for each composite structure. Such embedded cables may be tensioned via, e.g., hydraulic jacks, for increasing the load capacity and longevity of each resulting composite structure (e.g., floor or ceiling). A novel arrangement of such cables within the concrete, in combination with appropriate cable tensioning, results in unexpected strength for the volume of concrete used in fabricating such composite structures. More particularly, although the concrete for a composite structure may be poured so as to form a resulting load support surface (having an area of, e.g., a 1,000 square feet or more, this surface being orthogonal to the composite structure's thickness), the concrete provided within the composite structure includes a plurality of concrete beams in which at least some of the cables are embedded so that such concrete beams can be post tensioned along their lengths in a manner causes the composite structure to resiliently resist degradation (e.g., cracking) when supporting loads of substantial weight. Thus, a composite structure according to the present disclosure may include only a few inches thickness of concrete (e.g., in the range of 10 to 20 inches, and in some embodiments in the narrower range of 10 to 16 inches), but have the capacity to withstand or support loads typically requiring reinforced concrete of at least twice in thickness.

Each such composite structure includes (i) a first collection of (generally parallel) concrete "T" beams that are poured in-situ prior to pouring the load support surface, and, (ii) depending on, e.g., the dimensions of the load support surface, a second collection of one or more concrete beams is also included in the composite structure, wherein the second collection is also poured in-situ prior to pouring the load support surface. The second collection of one or more beams may be transverse or orthogonally oriented to the first plurality of concrete T beams. Moreover, the cables within the first and second collections of concrete beams may be separately post tensioned according to a predetermined protocol to thereby enhance the strength and durability of the composite structure.

The cables (also referred to as "tendons" in the art) within the first and second collections of concrete beams are tensioned during concrete curing to induce an upward or lifting bias, toward the load support surface. In particular, prior to concrete pouring for such beams, the cables are positioned within beam forms or recesses provided by the CFI panels so that the cables have, e.g., parabolic shapes induced by gravity within such forms or recesses. Thus, after the in-situ pouring and at least partial curing of the concrete, the post tensioning of the cables induce pressures or forces within the beams that resist (downwardly directed) loads placed on the support surface, and in particular, substantially reduces or prevents concrete failure and/or cracking. Thus, when the composite structure's load support surface is provided as, e.g., a floor or ceiling of a building, such beam internal cable pressures, or upwardly directed forces, increase the load capacity of the load support surface. Moreover, where the cables of the first collection of beams traverse the cable(s) of the second collection of beams, the cables of the first collection are spaced apart from the cable(s) of the second collection such that the cables of the first collection are supported in positions further toward the load support surface than the cable(s) of the second collection. Thus, although each cable of the first collection of beams may be configured (prior to concrete pouring) so that it hangs unsupported (i.e., parabolically) in each of one or more CFI panel forms or recesses, where such cables cross each cable, C, for the second collection of beams, each cable (for the first collection of beams) may be supported (prior to concrete pouring) a predetermined distance above (e.g., further toward the support surface than) the (parabolically hanging) cable C. Accordingly, at each such crossing of cables, there will be a predetermined extent of concrete provided between the crossed cables along the thickness of the composite structure. Thus, upon tensioning of the cables (for both the first and second collections of beams), the concrete between (and in proximity to) each such cable crossing is compressed by the cables of the crossing. Since the thickness of the concrete at each such cable crossing may include most of the thickness of each of the corresponding beams (one from the first collection and one from the second collection), such concrete is highly compressed thereby becoming what may be referred to as ultra-high-performance concrete (UHPC) having, e.g., a compression strength in that may be in excess of 150 megapascals (MPa=N/mm2), up to and possibly exceeding 250 MPa. Accordingly, such highly compressed concrete provided in both the first and second collections of beams substantially increases the load supporting capability of the composite structure's load support surface thereby substantially mitigating engineering failure issues like high fatigue strength that can occur in concrete load floors and ceilings.

In one embodiment, instead of steel cables (and corresponding steel post tensioning anchors), carbon fiber-reinforced polymer (CFRP) cables or tendons may be used in combination with nonmetallic anchors for post-tensioning the CFRP cables thereby providing a completely metal-free (non-corroding) post-tensioning of the composite structures. As with conventional steel anchors, the non-metallic anchors hold the CFRP cables through mechanical gripping but without the corrugations between wedges and the CFRP cables as one skilled in the art will understand. Each such nonmetallic anchor may include an outer barrel with a conical bore and four wedges. The nonmetallic anchor components may be made of ultra-high-performance concrete (UHPC), and the barrel may be wrapped with CFRP sheets to provide the confinement required to utilize the strength and toughness of UHPC fully. The concrete compressed via the CFRP post-tensioning may have compressive strengths in excess of 200 MPa together with excellent durability and fracture toughness.

In one embodiment, one to five millimeter (preferably three millimeter) chopped carbon fibers may be incorporated into the concrete of the composite structures to enhance its fracture toughness or resistance.

In addition, the T-panel system disclosed herein allows for an almost unchanged load distribution and serviceability even after considerable overload, since temporary concrete cracks close again after the overload has been removed from the load support surface. As already mentioned above, the T-panel system allows for much larger spans and reduced thickness, the latter resulting in reduced dead load, which also has a beneficial effect upon other structural members of a building having such composite structures, wherein the other structural members may be, e.g., bearing walls, columns, foundations. Additionally, by utilizing the composite structures, there may be a reduction in the overall height of a building, or alternatively, additional floors to be incorporated in a building of a given height.

Moreover, under a permanent load (e.g., on the load support surface), a composite structure provided by the T-panel system disclosed herein allows for a well-above-average structural behavior regarding deflections and cracking. For example, such a composite structure provides a much higher punching shear strength due to the lifting forces distributed within the composite structure by distributed crossings of the post tensioned cables within composite structure.

The cost in fabrication of the composite structures disclosed herein is substantially reduced for the loads (e.g., equipment, snow, interior furnishings, etc.) that can be effectively and reliably supported when compared to alternative floor or ceiling methods of fabrication. In particular, for an engineered load capacity, the composite structures can be fabricated using, e.g., a reduced quantity of concrete and steel. For example, this is due (at least in part)), to the reduced amplitude of stress changes in the composite structure when exposed to varying loads. Said another way, the composite structure's load support surface deflects a reduced amount for a given load being supported as compared with alternative construction systems.

Further benefits of the T-panel system are numerous, and in particular, the following benefits are provided.

(a) The reduced weight of the CFI panels allows a 2-person crew to install the composite structures for floors, decks and roofs at a rate of 100 square feet per hour, thus eliminating the need for a crane and related costs, such as stripping or removing concrete forms (after curing). Additionally, the T-panel system reduces the shoring (e.g., cost and labor related to the shoring phase. For example in a concrete commercial building this cost can easily reach $10,000 per day), etc. making T-panel system approach to building fabrication substantially more cost-efficient over prior art building fabrication techniques.

(b) The resulting composite structures have very high fire resistance (e.g., a fire resistance rating for structure fabricated according to the present T-panel system is approximately 5.5 hours. As a comparison a stick frame house with same floorplan will collapse in 35 minutes. Also, the EPS for the EPS panels already contains flame-retardant additives as part of the chemical composition of EPS), improving safety and reducing fire insurance costs.

(c) The resulting composite structures have increased structural capacity to reduce the impact of wind and earthquake damage. Such increased capacity is due to the increased loads that the composite structures can safely and reliably withstand without failure.

(d) The combined concrete and insulation of the composite structures provide both sound dampening and absorption which greatly reduces noise levels. Because of the excellent sound deadening properties of certain insulative materials (e.g., EPS), the CFI panels may reduce the noise transmitted through the floors and/or ceilings provided by the composite structures. Thus, the T-panel system herein improves the quality of living space and is particularly beneficial for multi-dwelling-unit structures and multi-tenant office buildings.

(e) Because of its superior strength, the composite structures disclosed herein can utilized to extend residential basements under, e.g., a garage area. In particular, since the composite structures can support substantially greater loads than prior art building techniques using, e.g., a comparable volume of comparable reinforced concrete, the weight of one or more automobiles and related heavy loads likely to reside in a garage can be readily supported by the composite structures. More particularly, the composite structures disclosed herein are less than half the weight of comparable prior art precast floors or ceilings providing a same load capacity.

(f) Since the composite structures are substantially less expensive to fabricate, lower cost floor space that can be provided for both residential and commercial buildings.

(g) The T-panel system (and resulting composite structures) allows building designers to create large, open and complex vaulted interior spaces. For example, this T-panel system allows for a positive roof connection (of a composite structure) to structural wall members which is a major concern in hurricane prone areas of the country. In recent testing conducted by the Portland Cement Association, following guidelines set forth in the ASTM-E564-95 (standard practice for static loads test for shear resistance of framed walls for buildings) the higher strength of concrete structures suggests that when this composite structures fabricated according to the T-panel system is subjected to lateral in-plane loading from sources such as wind or earthquake, such composite structures are not only considerably stronger but also much stiffer than traditional stick framed wall or floor panels. The higher strength of such composite structures enables, e.g., homes and other buildings fabricated using such composite structures to resist winds, hurricanes, tornadoes or earthquakes of much higher magnitudes. The higher stiffness of these composite structures result in, e.g., vertical walls fabricated from such composite structures, having loading limits of smaller or virtually non-existent lateral deformation, and thus providing greater protection from potential damage to non-structural elements of a home or building such as finishes and trim.

Moreover, since the composite structures have increased strength and resistance to load failure, reduced materials for fabrication (to obtain corresponding strength and resistance to failure) as well as reduced fabrication labor, military and emergency preparedness applications can be much better addressed by the T-panel than prior art construction techniques. For example, the U.S. military and FEMA (Federal Emergency Management Agency) have devoted considerable effort to assisting in the development and deployment of cost effective dwellings. However, such dwellings typically have a reduced ability to withstand intense and/or very high stress loads (e.g., explosions, hurricanes, tornados, floods, artillery fire, certain rock slides, etc.). Accordingly, the use of the composite structures disclosed herein for constructing more permanent and/or durable dwelling structures, can be an additional or alternative dwelling construction technique, e.g., particularly in hazardous and/or extended stay conditions.

A further benefit of the composite structures is their energy efficiency. In particular, the composite structures may have a nominal insulation value of R-50 or higher, depending on the thickness of, e.g., the CFI panels, the concrete slab, and the finish flooring provided.

In one embodiment, heat storage/release components/equipment may be integrated into the composite structures. In particular, heat storage and/or release conduits can be distributed within the concrete slab (and/or the corresponding concrete T beams or transverse beams described herein) without affecting the load bearing capacity of the resulting composite structures.

In one embodiment, when the composite structures disclosed herein are combined with concrete sandwich walls (ICF), a building envelope may be constructed that is exceptionally energy efficient. Moreover, by also utilizing photovoltaic panels and other forms of renewable energy such as wind energy, geothermal, and hot water solar panels, a building constructed using the composite structures may be substantially self sufficient requiring little energy from commercial sources such as electrical utility companies.

DETAILED DESCRIPTION

Figure 1:
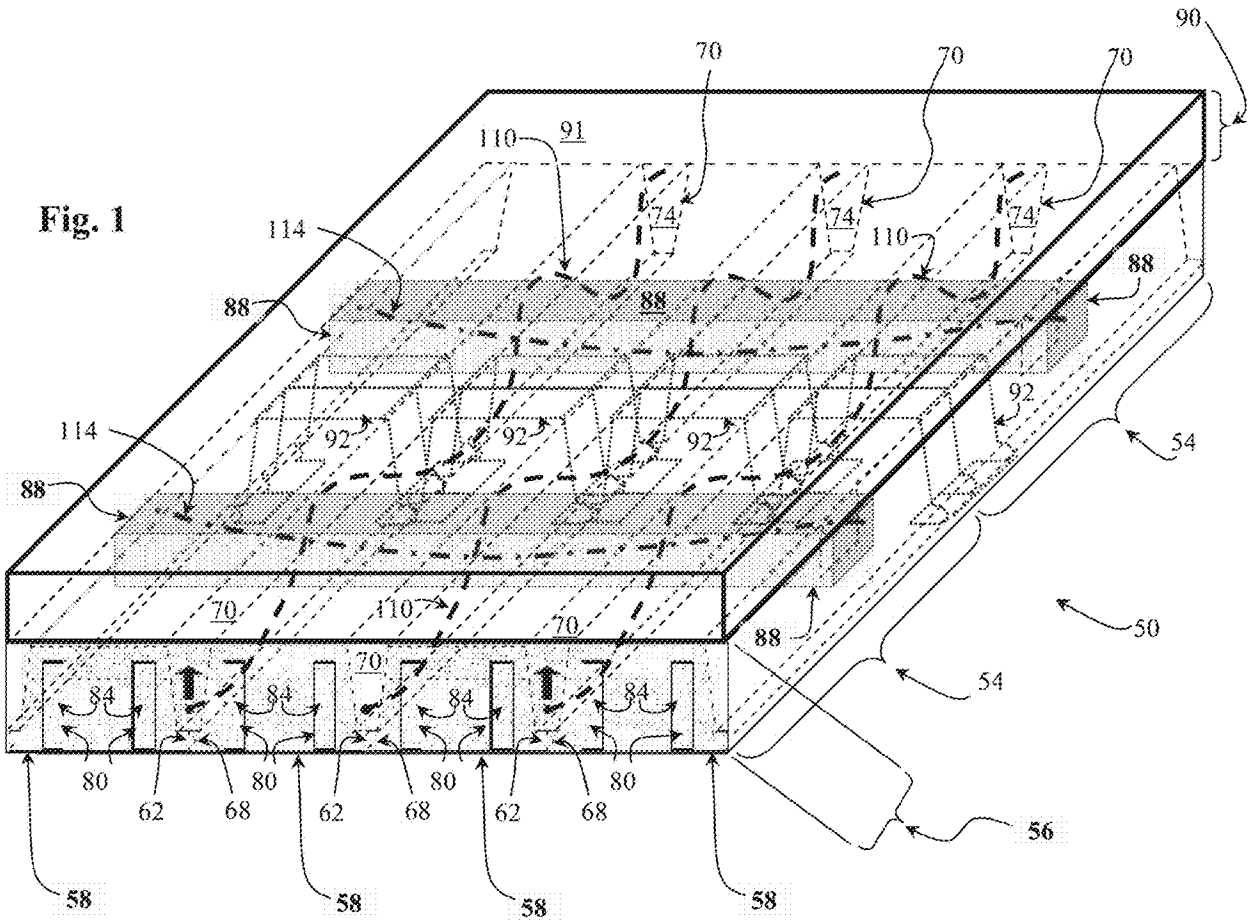
FIG. 1 shows a perspective view of a portion of an embodiment of the composite structure 50 according to the present disclosure, wherein internal structural components of the composite structure is illustrated.
Figure 2:
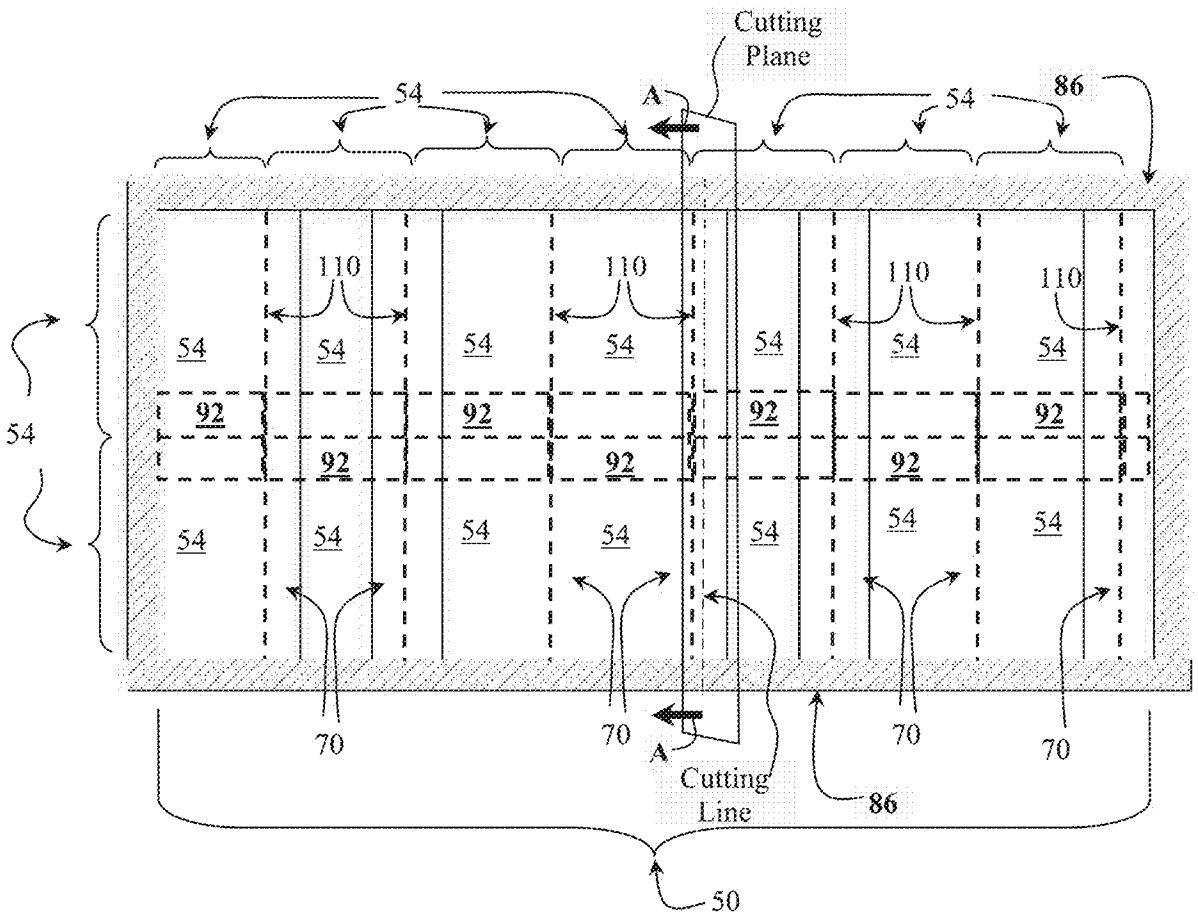
FIG. 2 a plan view of another embodiment of a composite structure 50 according to the present disclosure.

In order to provide a more full disclosure of the T-panel system and the composite structure fabricated therefrom, the following U.S. Patents are fully incorporated herein by reference:

(a) U.S. Pat. No. 8,020,235 by Nabil F. Grace filed Sep. 16, 2008 which is directed to an improved prestressed concrete bridge having internal and external tensioning tendons which follow approximately similar pathways which are not straight;

(b) U.S. Pat. No. 6,119,417 by Valverde et. al. filed Jun. 9, 199 which is direct to a roof structural system for use in all building types (i.e. single family homes, apartment buildings, condominiums, churches, etc.) consisting of precast, prestressed and/or post-tensioned concrete elements assembled in the field and complemented with poured in place concrete. These elements may consist of slabs, beams, soffits and/or any other structural component susceptible of being preprogrammed and precast in other than the job site;

(c) U.S. Pat. No. 7,596,915 by Lee et. al. filed May 29, 2007 which is directed to a method of forming an insulated concrete foundation comprising constructing a foundation frame, the frame comprising an insulating form having an opening, inserting a pocket former into the opening; placing concrete inside the foundation frame; and removing the pocket former after the placed concrete has set, wherein the concrete forms a pocket in the placed concrete that is accessible through the opening. The method may further comprise sealing the opening by placing a sealing plug or sealing material in the opening. A system for forming an insulated concrete foundation is provided comprising a plurality of interconnected insulating forms, the insulating forms having a rigid outer member protecting and encasing an insulating material, and at least one gripping lip extending outwardly from the outer member to provide a pest barrier. At least one insulating form has an opening into which a removable pocket former is inserted. The system may also provide a tension anchor positioned in the pocket former and a tendon connected to the tension anchor;

(d) U.S. Patent Application Publication No. 2006/0230696 by Sarkkinen filed Mar. 28, 2006 which is directed to a tendon-identifying, post-tensioned, elevated concrete slab, and method and form panel apparatus for constructing the same, which provides a distinctively-patterned bottom side slab surface in which the slab has a full thickness dimension extending along each individual post-tensioning uniform and banded tendon embedded within the slab and a reduced-thickness dimension in the areas between each individual, adjacent laterally spaced apart, longitudinally extending uniform tendon of the post-tensioning system, whereby the location of embedded tendons can be identified by the full thickness areas of the slab appearing as prominent, elongated rib-like surfaces extending between inwardly recessed surfaces of the bottom side of the slab;

(e) U.S. Pat. No. 4,574,545 by Reigstad et. al. filed Mar. 30, 1984 which is directed to a method for installing a new steel tendon and for repairing a damaged or deteriorated steel tendon in a prestressed concrete slab. The repair method includes the steps of relieving substantially all stress in the defective original tendon, removing the original tendon, installing a new tendon in the space vacated by the original tendon, installing new concrete around the new tendon to replace any original concrete removed while removing the original tendon, and stressing the new tendon thereby again prestressing the previously structurally defective slab. Installation of a tendon where none has previously existed is similar except an original tendon need not be removed;

(f) U.S. Pat. No. 3,693,310 by Middleton filed Nov. 9, 1970 which is directed to a support for reinforcing members (e.g., tensioning cables) used in fabricating concrete structures including a base and an upright portion which is formed to receive and support two intersecting reinforcing members in a concrete structure at the point where the members intersect. The support holds the reinforcing members during the pouring of concrete to maintain the reinforcing members at a predetermined position with reference to the ground or the outer surface of the concrete structure;

(g) U.S. Patent Application Publication No. 2004/0206032 by Messenger et. al. filed Feb. 3, 2004 which is directed to an insulative, lightweight building panel is provided with a lightweight, insulative foam core and which includes one or more carbon fiber or steel reinforcements and an exterior concrete face which are manufactured in a controlled environment and can be easily transported and erected at a building site.

FIG. 1 shows the internal structure of an embodiment of a composite structure (50) according to the present disclosure. The composite structure 50 includes a plurality of interlocking CFI panels 54 (also shown in FIGS. 6, 7, 8, 9, 16, and 17) that form a lower most layer 56 of the composite structure 50. The CFI panels 54 provide forms into which concrete for the composite structure 50 is poured in fabricating the composite structure. Furthermore, the CFI panels 54 may be made of an insulative material such as certain recycled plastics. In particular, the CFI panels 54 may be composed of one or more of:

(a) Polyethylene terephthalate (PET, PETE), used in soft drink, water and salad dressing bottles, peanut butter and jam jars;

(b) High-density polyethylene (HDPE), used in water pipes, hula hoop rings, five gallon buckets, milk, juice and water bottles; grocery bags, some shampoo/toiletry bottles;

(c) Polyvinyl chloride (PVC), used in blister packaging for non-food items, cling films for non-food use, electrical cable insulation, rigid piping; vinyl records;

(d) Low-density polyethylene (LDPE), used in frozen food bags; squeezable bottles, e.g. honey, mustard; cling films; flexible container lids;

(e) Polypropylene (PP), used in reusable microwaveable ware, kitchenware, yogurt containers, margarine tubs, microwaveable disposable take-away containers, disposable cups and plates;

(f) Polystyrene (PS), used in egg cartons, packing peanuts, disposable cups, plates, trays and cutlery, and disposable take-away containers;

(g) Other (often polycarbonate or ABS) used in beverage bottles; baby milk bottles, compact discs, "unbreakable" glazing, electronic apparatus housings, lenses including sunglasses, prescription glasses, automotive headlamps, riot shields, instrument panels.

However, in one embodiment, recycled EPS is preferred.

Figure 7:
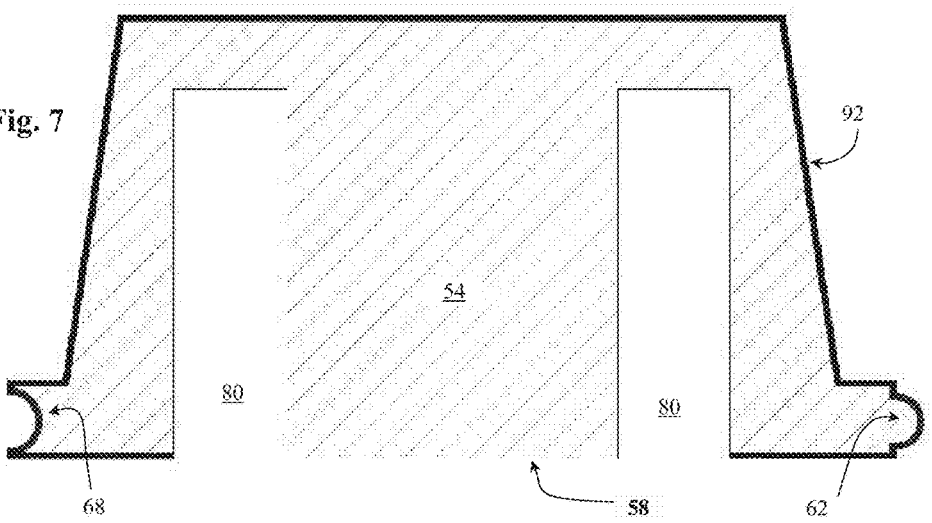
FIG. 7 shows a cross section of a CFI panel 54 wherein this cross section is taken at an end of the CFI panel that is inserted into the recess 96 of a sleeve 92.
Figure 8:
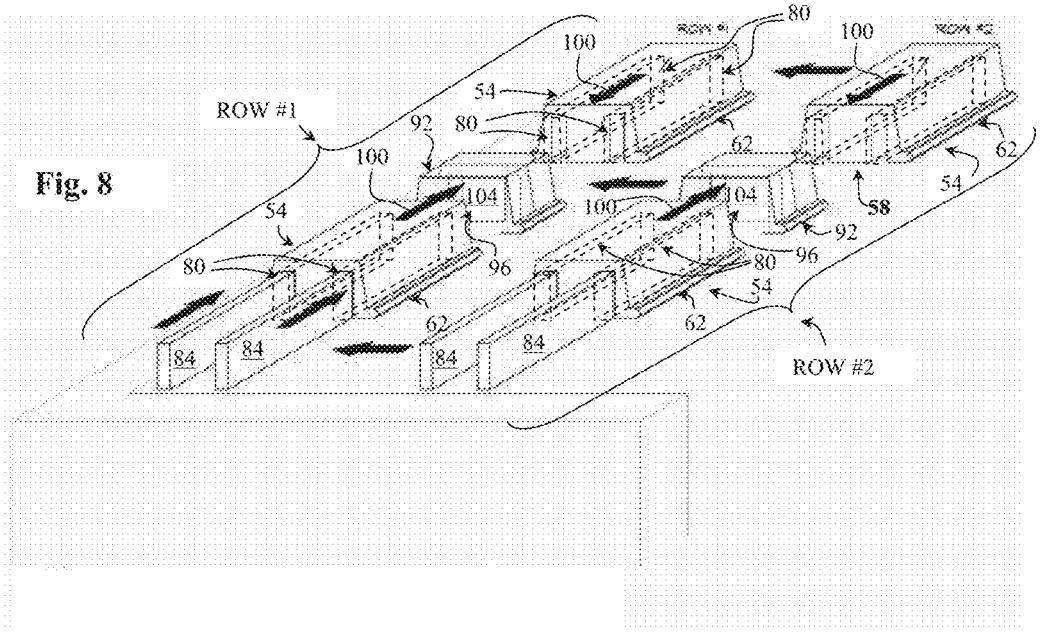
FIG. 8 shows an exploded view of the components for constructing the layer 56 (FIG. 1) of the composite structure 50, wherein the solid heavy black arrows provide indications of how the CFI panels 54, the sleeves 92, and their supports 84 fit together in fabricating the layer 56. Note that the supports 84 are shortened in FIG. 8 for illustration purposes.
Figure 9:
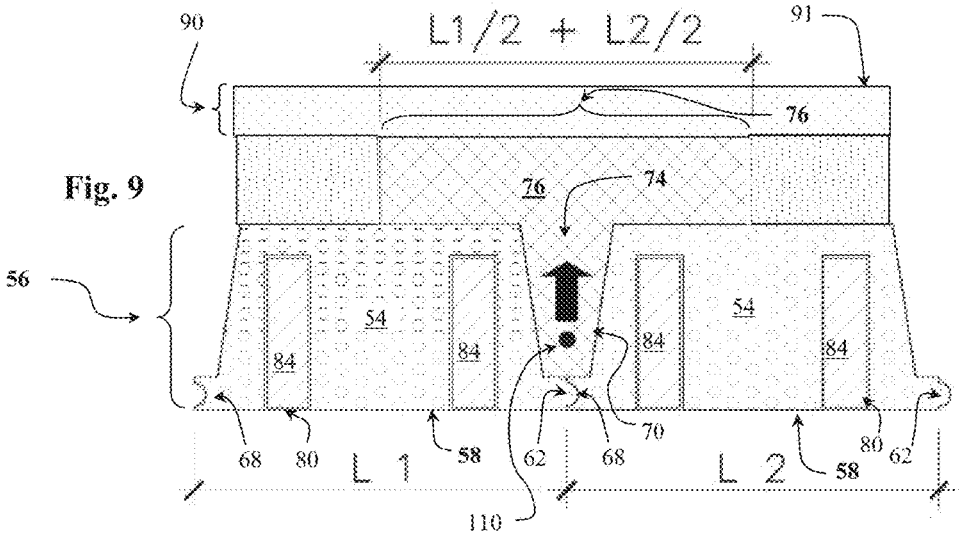
FIG. 9 shows another cross section of an embodiment of the composite structure 50 showing a cross section of a T-beam 76 and a showing the upwardly directed force or pressure induced by a post tensioned cable embedded in the concrete of the center leg 74 of the T-beam.

Referring particularly to FIGS. 7, 8 and 9, each CFI panel 54 has, adjacent to its base surface 58, at least one (and for most panels both) a male interlock 62 and a female interlock 68, wherein (as shown in FIGS. 1, 9, 16, and 17) immediately adjacent CFI panels of the layer 56 couple together via mating of their corresponding interlocks 62 and 66. When such CFI panels 54 are coupled to one another (as in FIGS. 1 and 4), a recess 70 having a closed bottom is provided along the length of the coupled CFI panels. As described further hereinbelow, each such recess 70 serves as a form into which concrete is poured for fabricating the center (vertical) leg 74 of a corresponding concrete "T" beam 76 (e.g., FIG. 9).

Opening from the base 58 of one embodiment of the CFI panels 54 is at least one (and preferably a plurality) panel support openings 80 (FIGS. 1, 6, 7, 8, and 9) for receiving temporary supports 84 for supporting the initial weight of the composite structure 50, particularly the concrete, at least until such concrete gains a required design strength (e.g., usually 2-3 days as one skilled in the art will understand). Such supports 84 may be composed of various materials, including wood, steel or another metal, and such supports may vary in their configurations. In FIGS. 1, 3, 5, 6, 7 and 8, the supports 84 have a rectangular cross section (i.e., the cross section being traverse to the length of each support). However, supports 84 having "T" cross sectional (or other) shapes are also within the scope of the present disclosure. In one embodiment, the supports 84 may be 16 gauge steel or steel alloy with a "T" cross section. Note that such supports 84 may be provided every 12 inches on center to carry the temporary construction loads for fabricating a resulting composite structure 50.

During fabrication of the composite structure 50, the CFI panels 54 are positioned (and interlocked with one another) on supports 84, wherein such supports are inserted into the openings 80 as shown in FIGS. 1, 3, 5, 8, and 9. Note that each such support 84 spans a length of the composite structure 50, such that at least at the ends of the supports are securely connected to a wall or cross member (e.g., walls 86, FIGS. 4 and 11). Accordingly, the supports 84 function as temporary supports for the composite structure 50 until the concrete of the composite structure cures and is able to support not only the composite structure 50, but also significant loads many times the weight of the composite structure 50 (e.g., in some embodiments, in a range of 6 to 12 times the weight of the composite structure).

Figure 10:
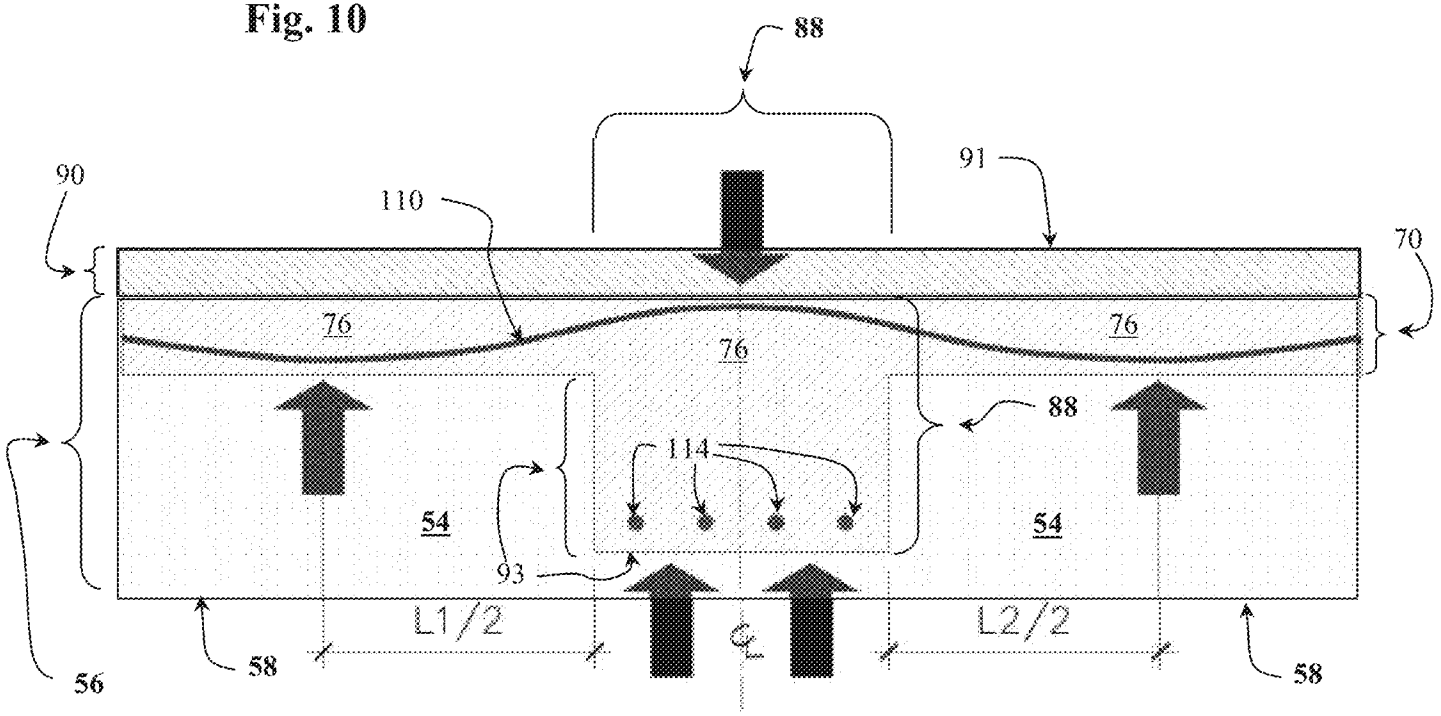
FIG. 10 is cross section of an embodiment of the composite structure 50 similar to the cross section of FIG. 5; however, the present figure shows arrows of the forces or pressures induced by the various post tensioned cables embedded in the concrete of the center leg 74 of the T-beam and in the transverse beam 88.

If the desired span for a composite structure 50 is, for example, 60 feet, a concrete post-tensioned transverse beam 88 may be required at the 30 feet span location (see FIGS. 4 and 5) whose concrete is typically poured with the pouring of the concrete T beams 76. The concrete form or channel 93 (FIGS. 5, 10 and 11) for each such transverse beam 88 can be easily provided by cutting the channel into the CFI panels 54 of the composite structure 50, wherein the channel may be, e.g., 18 inches wide and is 6 inches deep across the widths of the CFI panels. In particular, for a given composite structure 50, each such channel 93 preferably extends perpendicularly to the recesses 70 for the concrete T beams 76, and the channel traverses across the entire width of the assembled CFI panels 116 in a straight path. Note by providing each channel 93 in this manner, the corresponding transverse beam 88 is entirely concealed within the thickness of the composite structure 50. Thus, when the composite structure 50's side 94 (on the opposite side to that of the load support surface 91) is finished as a ceiling, there is no need for dropping the ceiling level to accommodate traverse beam 88 projections. Note that each such channel cutting may be accomplished using common hand tools, such as saws or hot knifes.

It is worth noting that in one embodiment described further below, the pouring of the beams 76 and 88 are performed in a first pouring step, and subsequently a second pouring step is performed for pouring the concrete upper slab 90 having load support surface 91 upon which the primary loads are designed to be experienced by the composite structure 50.

Once the concrete for the T beams 76 and (if provided) traverse beam(s) 88 (FIGS. 1, 5, 4, 10, and 11) is fully cured, these beams become the primary load bearing components of the composite structure 50.

For securing the CFI panels 54 together to form rows (e.g., rows #1 and #2 of FIG. 8), a panel sleeve 92 (FIGS. 1, 2, 3, 5, 6, 7, and 8) is provided between facing ends of immediately adjacent CFI panels. Each panel sleeve 92 includes two panel receiving recesses 96, each of which snugly fits the exterior contour of an end of a CFI panel inserted therein (e.g., according to the arrows 100, FIG. 8) thereby stabilizing each row of CFI panels 54 so that torsional forces on individual CFI panels (e.g., due to the weight of concrete when poured) are distributed over at least the CFI panels in an entire row of CFI panels (and adjacent rows). Such panel sleeves 92 may be composed of a 3/16 inch thick plastic, in one embodiment, being any of the plastics listed in (a) through (g) above. Each sleeve 92 may have a longitudinal dimension L (FIG. 6) of, e.g., 12 inches. The CFI panels 54 are inserted into the recesses 96 in a manner so that the sleeves 92 and CFI panels 54 alternate along the length of each row of length-wise aligned CFI panels (as in FIG. 8). In particular, at least one end of each CFI panel 54 slides into an adjacent recess 96 for a predetermined extent (e.g., 6 inches). Each sleeve 92 includes a center sleeve divider 104 which serves as a stop for identifying to a worker when a CFI panel 54 has its end fully seated within the sleeve's corresponding recess 96. Moreover, since each such sleeve divider 104 substantially covers the two CFI panels 54 that abut up against each of the divider's two vertical sides, the divider further assists in stabilizing and distributing torsional and other forces that may be induced on the layer 56 during the pouring of concrete thereon.

The composite structure 50 also includes at least one cable or tendon 110 positioned in each of the recesses 70 for post tensioning the concrete of the T beams 76, and, if provided, at least one cable or tendon 114 positioned in each channel 91 for post tensioning the concrete of the transverse beam(s) 88. Each of the cables 110 and 114 may be a 270 Ksi 7 strand steel cable of low relaxation. Other types of cables may be used including nonmetallic cables of, e.g., carbon fiber, and 9 strand steel cables. However, such cables 110 and 114 must be able to be tensioned with, e.g., hydraulic jacks after the cables are embedded in partially cured concrete. In particular, such cables are post tensioned after the concrete reaches a predetermined minimum strength of, e.g., 3,000 psi. Such cables 110 and 114 may be configured or positioned in various predetermined arrangements for enhancing the structural properties of the resulting composite structure 50 (e.g., as shown in FIGS. 1, 2, 3, 4, 5, 9,10, and 11).

Figure 13:
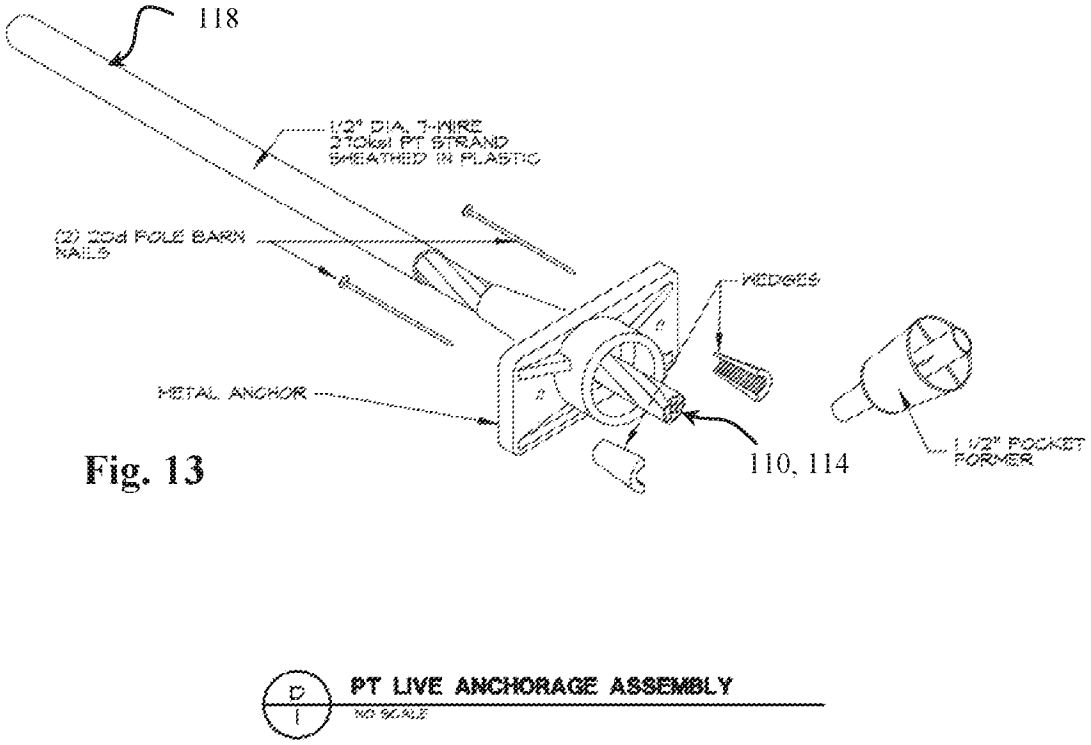
FIGS. 13 and 14 show embodiments of a cable or tendon used for post tensioning the concrete of the composite structure 50.
Figure 14:
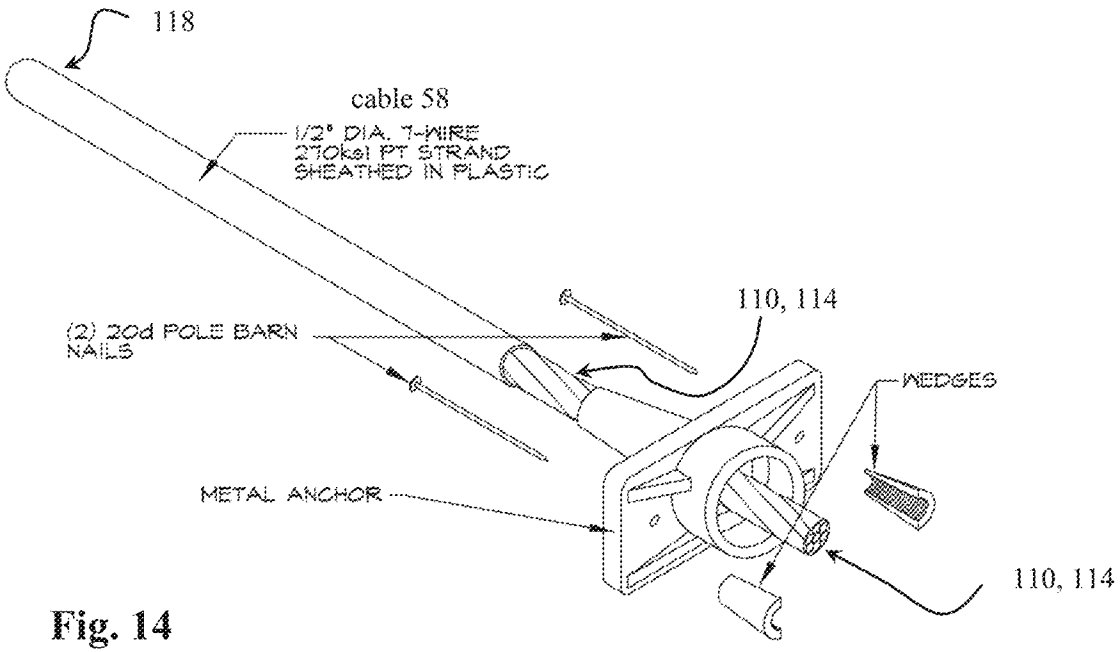

If each such cable 110 and 114 comprises a non-corrosion resist material (e.g., steel), then the cable may be provided in a thick plastic sheathing and/or tubing (labeled "118" in FIGS. 13 and 14). The plastic sheathing and/or tubing 118 can be produced of either polyethylene or polypropylene having, e.g., at least 1 mm in wall thickness. In one embodiment, the plastic tubing and/or sheathing 118 is extruded over each cable 110 and 114 (as shown in FIGS. 13 and 14). The plastic sheathing or tubing 118 forms a primary corrosion protection for the cables 110 and 114. However, grease (other corrosion protectant, e.g., silicon) also may be provided around each of the cables 110 and 114 thereby forming a secondary corrosion protection barrier. The plastic covered cables 110 and 114 may serve as a replacement for at least some (if not most) of what would be typically be steel reinforcing bars embedded in the concrete for the composite structure 50.

Regarding the cables 110, such cables may be configured and placed in the recesses 70 so that these cables conform to one or more parabolic shapes induced by gravity within the recesses 70 as shown in FIGS. 1, 3, 5, 10 and 11. Thus, after the in-situ pouring and at least partial curing of the concrete in the recesses 70, the post tensioning of the cables 110 induce pressures or forces within their corresponding T beams 76 for resisting (downwardly directed) loads placed on the load support surface 91, and in particular, such post tensioning substantially reduces or prevents concrete failure and/or cracking. Thus, although each cable 110 may be configured (prior to concrete pouring) so that it hangs unsupported (i.e., parabolically) in each of one or more CFI panel forms or recesses, where such cables 110 cross each cable 114, each cable 110 may be supported (prior to concrete pouring) a predetermined distance above (e.g., further toward the support surface than) the (parabolically hanging) cable 114. Accordingly, at each such crossing of cables, there will be a predetermined extent of concrete provided between the crossed cables 110 and 114 along the thickness of the composite structure.

In one embodiment, the T-beams may be spaced at 2'-0" on center, in an arrangement that induces a lifting to a floor (provided by one or more of the composite structures 50 in those areas where cracked moment capacities become very critical. In particular, such lifting of such floors are a technical and economical advantages of the T-panel system disclosed herein.

In one embodiment, the CFI panels 54 may have a dual purpose for the composite structure in that once the concrete therein is properly cured, the CFI panels may also act as integral furring strips to which interior living space finishes, such as drywall can be attached.

The T-panel system is based on at least two different approaches or methods for fabricating the composite structures 50. The method utilized for the design and fabrication of the T beams 76 is based on the theory of the elasticity of the concrete material therein, while method utilized for the design and fabrication of the traverse beams 88 is preferably based on the theory of the plasticity of the concrete material therein.

The approach or method for the design and fabrication of the T beams 76 may be based on the T beams 76 being designed to take into consideration the calculation of each individual T beam moment and the shear forces that would be generated when a maximum load is applied on the load support surface 91 of the composite structure 50 containing the T beams. In other words, moments and shear forces resulting from applied loads on the load support surface 91 are calculated according to the elastic theory of concrete for each individual T beam 76 (taking into account the cable 110 therein and its related tensioning and pre-stressed forces or internal pressures within the T beam as one skilled in the art will understand). Although, in the equation, the pre-stressed tensioning of a cable 110 is not considered as an applied load. It should be taken into account in the determination of the ultimate strength of the T beam. No moments and shear forces due to pre-stress and therefore also no secondary moments should be calculated. This applies only for the first main section. The moments and shear forces due to applied loads multiplied by the load factor must be smaller at every section than the ultimate strength divided by the cross-section factor. The ultimate limit state condition to be met may therefore be expressed in the following formula:

$$S\times\gamma f\leq R\wedge\gamma m$$

where S represents the shear forces, γf the gamma load factor, R the ultimate strength and γm the cross section factor.

Regarding the traverse beams 88, the loading calculation, the forces resulting from the curvature of the pre-stressed cables 114 in each transverse beam 88, must be treated at all times as an applied load to the T beams 76. This is necessary for determining the maximum T beam 76 load calculations and in determining the secondary moments for the T beams, and therefore for determining the load calculation for the corresponding composite structure 50. The innovative consideration of the placement of a transverse structural component and its related upper tensioning and forces, results in a very balanced load diagram throughout the structure and also keeps all the deflections in a very low range and within the limits allowed by the plasticity of the concrete material.

Regarding the transversal beam, as explained above, a theory of plasticity is being utilized for the calculation and the design of the structural component. The following explanations show how its application is best suitable for the design of this specific and secondary transversal structural component:

The condition to be fulfilled at failure here is the following:

$$[(g+q)u/g]+q\geq\gamma$$

where γ=γf×γm.

Figure 4:
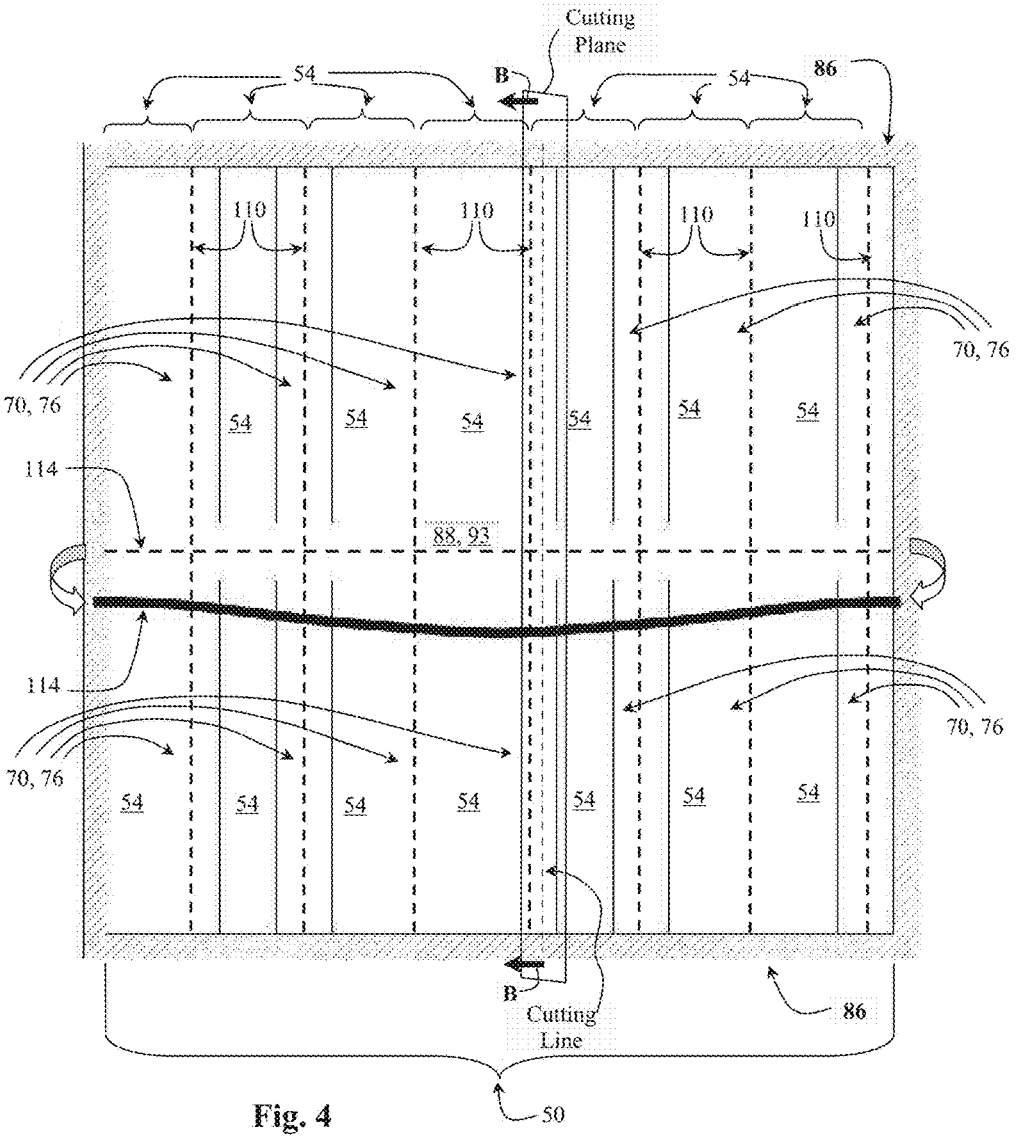
FIG. 4 shows a plan view of another embodiment of a composite structure 50 according to the present disclosure. In addition to the plan view of the cable 114, the present figure also shows a side view of the cable 114 for illustrating the parabolic shape of the cable 114.
Figure 5:
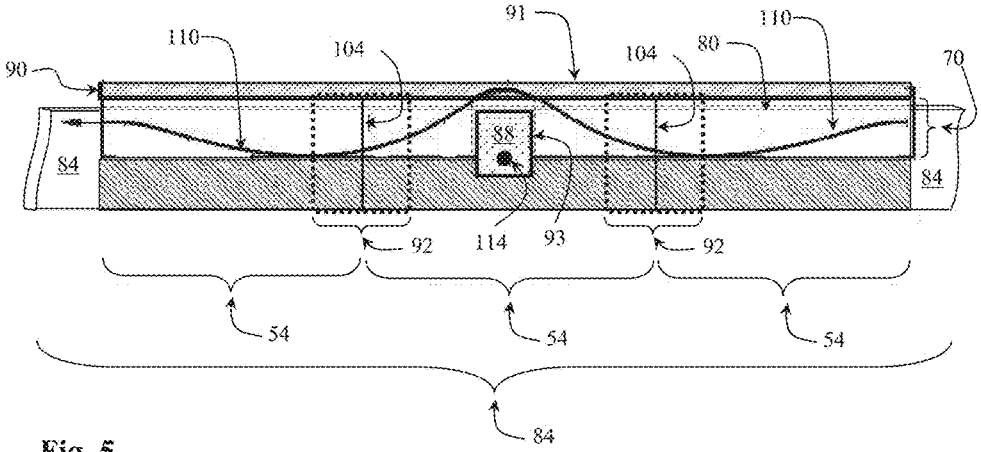
FIG. 5 shows a cross section of the composite structure 50 of FIG. 4, wherein this cross section is (i) determined by the cutting plane shown in FIG. 4 cutting through the composite structure 50 perpendicular to its planar top most load support surface 91 along the cutting line identified in FIG. 4, and (ii) viewed from the perspective of looking in the direction of arrows "B" shown in FIG. 4. Note that for greater clarity of presentation of the internal structure of the composite structure 50 embodiment, certain features are not cross hatched, shaded or not dashed.
Figure 11:
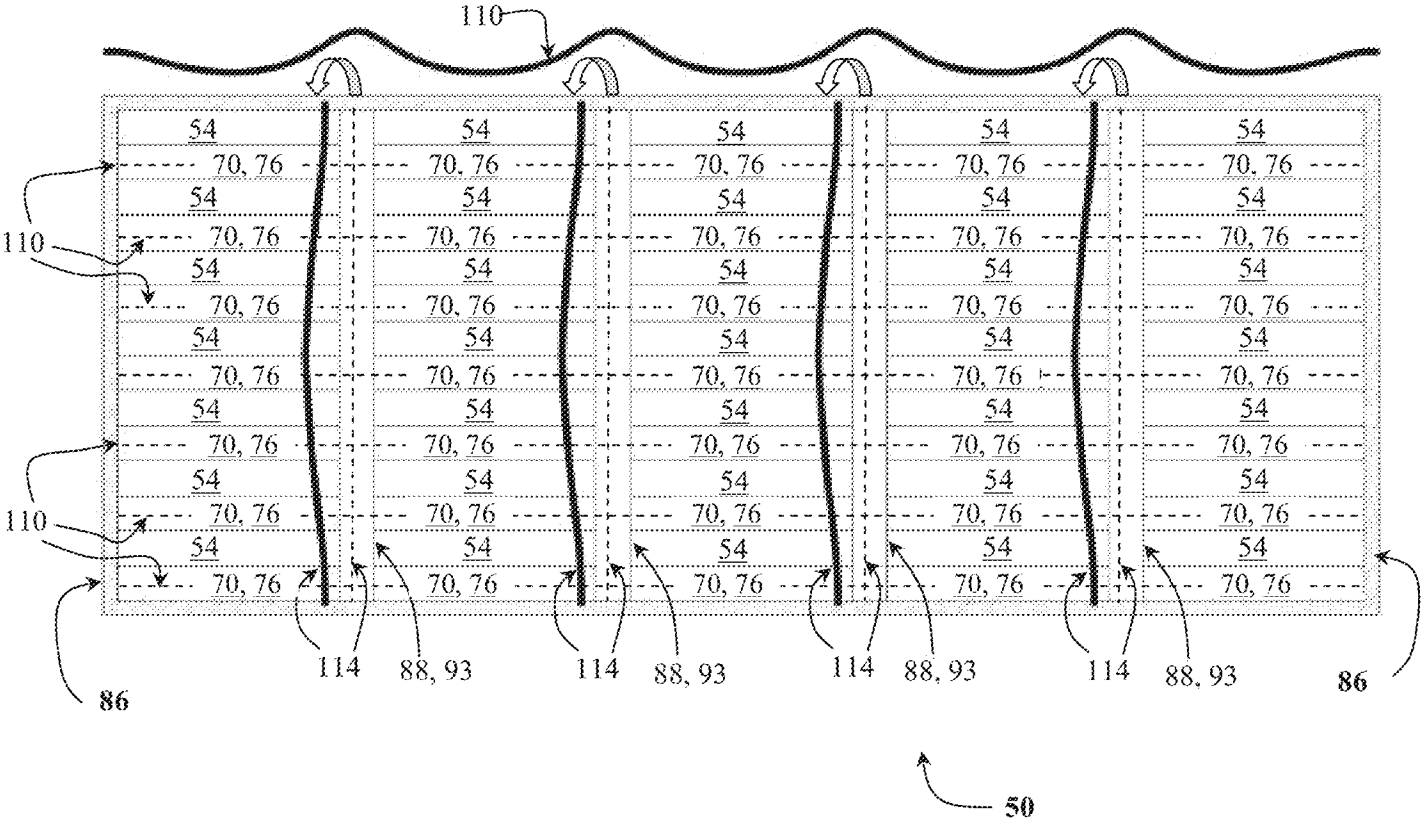
FIG. 11 shows a plan view of another embodiment of the composite structure 50 wherein a plurality of transverse beams 88 are shown. In addition to the plan view of the cables 110 and 114, the present figure also shows a side view of the cables 110 and 114 for illustrating their parabolic shapes.

The ultimate design loading (g+q)u divided by the service loading (g+q) must correspond to a value at least equal to the safety factor γ. The most accurate method of determining the ultimate design loading (g+q)u is by utilizing a kinematic approach, which provides an upper boundary for the ultimate load scenario. The mechanism that has been chosen is the one that leads to the lowest load. FIGS. 4 and 11 illustrate this mechanism for all of the internal spans. Since the system doesn't consider the presence of a column or bearing point at mid span, the ultimate load can be determined to a high degree of accuracy by the subtraction of the positive pre-stressed forces within the transversal beam from the positive pre-stressed forces within the longitudinal beams of the panel system. In the region of the maximum cracked moment which lies exactly at mid span, most of the internal shear forces are thereby balanced out, which leads to the result that the load calculated in this way lies very close to the ultimate load or below it. On the assumption of a uniformly loading distribution, the ultimate design loads for the main sections are always calculated by using the width L1/2+L2/2. The ultimate load calculation can then be always carried out for a strip or section equals to the unit width. The final load corresponding to the transversal beam section can then be obtained by the principle of virtual work. This principle states that, for a virtual displacement, the sum of the work We performed by the applied forces and of the dissipation work W, performed by the internal forces must be equal to zero.

Furthermore, in one embodiment, substantially any type of interior finish can be mechanically attached to the steel beams provided as part of each such composite structural member. In particular, such steel beams may function as furring strips when, e.g., self-tapping screws are used to attach interior finish panels such as sheet rock or dry wall to the temporary supports 84 (e.g., steel beams). For example, each sheet may be attached to a plurality of the steel beams embedded within the composite structural members. These connection mechanisms are an integral part of the "T" panel system disclosed herein, with a spacing of 12 inches on center. On the top side of the panels, the concrete upper slab 90 with any type of appropriate finish available, from stained concrete products, acids, paint, tile, hardwood, carpet, etc.

Figure 16:
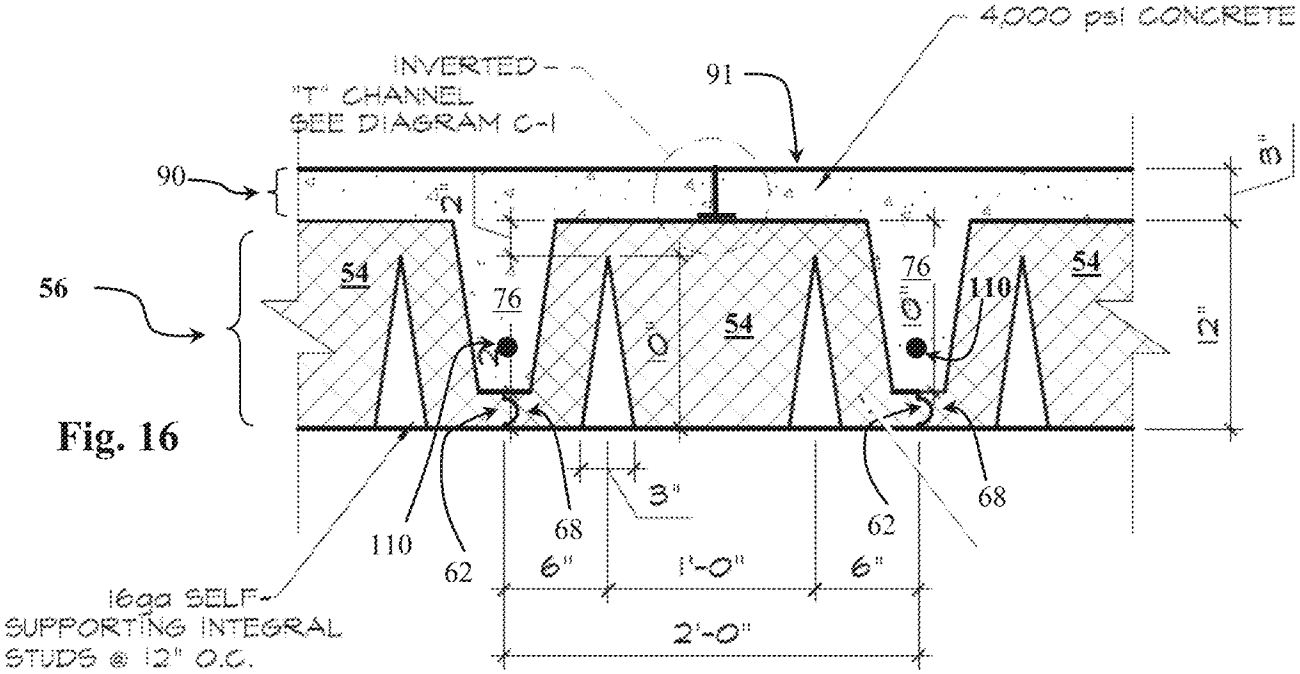
FIG. 16 shows a portion of a cross section of another embodiment of the composite structure 50, wherein the T beams 76 do not rise above CFI panels 54; i.e., in a first concrete pouring, the concrete for the T beams (and any traverse beams 88, not shown) is poured substantially only to the top of the CFI panels 54, and the concrete slab 90 is provided in a second different concrete pouring.
Figure 17:
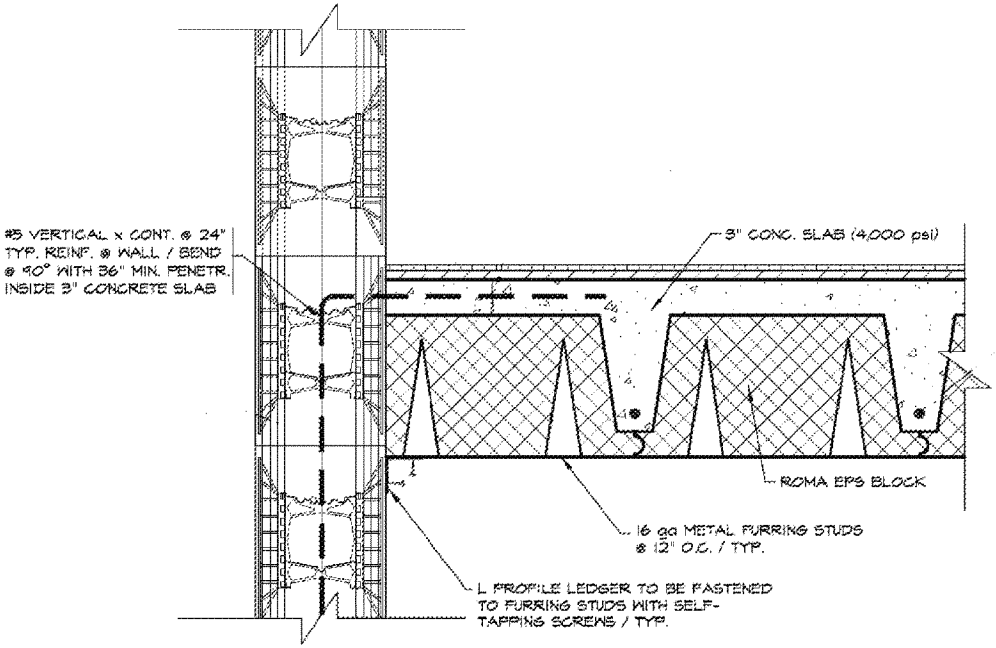
FIG. 17 shows how an embodiment of the composite structure 50 attaches to a wall.

In one embodiment (and as described also hereinabove), the interlocking CFI panels 54 may interlock with each other, e.g., via a tongue-and-groove design or other interlocking techniques (see cross-section in FIGS. 9, 16 and 17). By interlocking such CFI panels 54 together, improved stability properties (e.g., by eliminating such gaps in the panel assembly process, the risk of leaking concrete and relative aggregates is therefore eliminated). Moreover, such interlocking techniques may be also used prior full fabrication of a composite structure 50, wherein CFI panels 54 and the temporary supports 84 may be interlocked prior to the pouring of the concrete. Such interlocking temporary supports 84 facilitate rapid installation, and eliminate undesirable gaps that can occur during the concrete pouring process.

In at least one embodiment, the T-beams 76 of a composite structure 50 may measure 3" at the bottom and 12" high Such T beams 76 may be spaced at 24" on center and may be reinforced within the structural members via high strength tendons, tensioned with appropriate hydraulic jacks after the appropriate concrete curing. In particular, such tendons may have the following characteristics: 7-wire cable or tendon extruded in a minimum of 1 mm of plastic sheathing, with a cross sectional area of steel of 0.153 square inches, and a modulus of elasticity (E)=28,500,000 lbs/in$^2$.

In addition, each composite structure 50 may also include rebar as one skilled in the art will understand.

Utilities are easier to install with the T-panel system described herein. The interlocking CFI panels 54 can be easily removed (and/or channels carved therein) in those locations that require utility runs. Cutting interlocking CFI panels 54 is accomplished using common hand tools, such as saws or "hot knifes". This does not adversely affect the R-Value or structural integrity of the system.

The temporary supports 84 can be an integral part of the composite structure 50. The temporary supports 84 may be located approximately every six to eight feet on center. An installer is responsible for the design and correct installation of the system in accordance with the ACI (American Concrete Institute) 347-04 "Guide to Formwork for Concrete" or current applicable codes. Any variance from those standards must be provided and certified in advance by a Structural Engineer, licensed for the job site location and specifications.

T-Panel System Assembly

One embodiment for constructing each floor (e.g., of a multi-story building) via the composite structural members may be described as follows.

1. The assembly of the floor starts by securing one or more L-shaped ledges 104 at the desired height (see FIG. 17), along the walls 108 (only one wall shown in FIG. 17) for supporting a floor 112. Starting from one end of the building, the installers lay the first two integral 16 gauge steel beams (i.e., temporary supports 84 and secure them to the L-shaped ledges 104 on each side via self-tapping screws.
2. After completing the installation of the temporary supports 84, the CFI panels 54 are placed on top of the steel beams. For a more secure connection a foam adhesive can be used to secure each CFI panel 54 onto the temporary supports 84. In one embodiment, each such CFI panel 84 is provided within a panel sleeve 92 as shown in FIGS. 6, 7 and 8.

Figure 6:
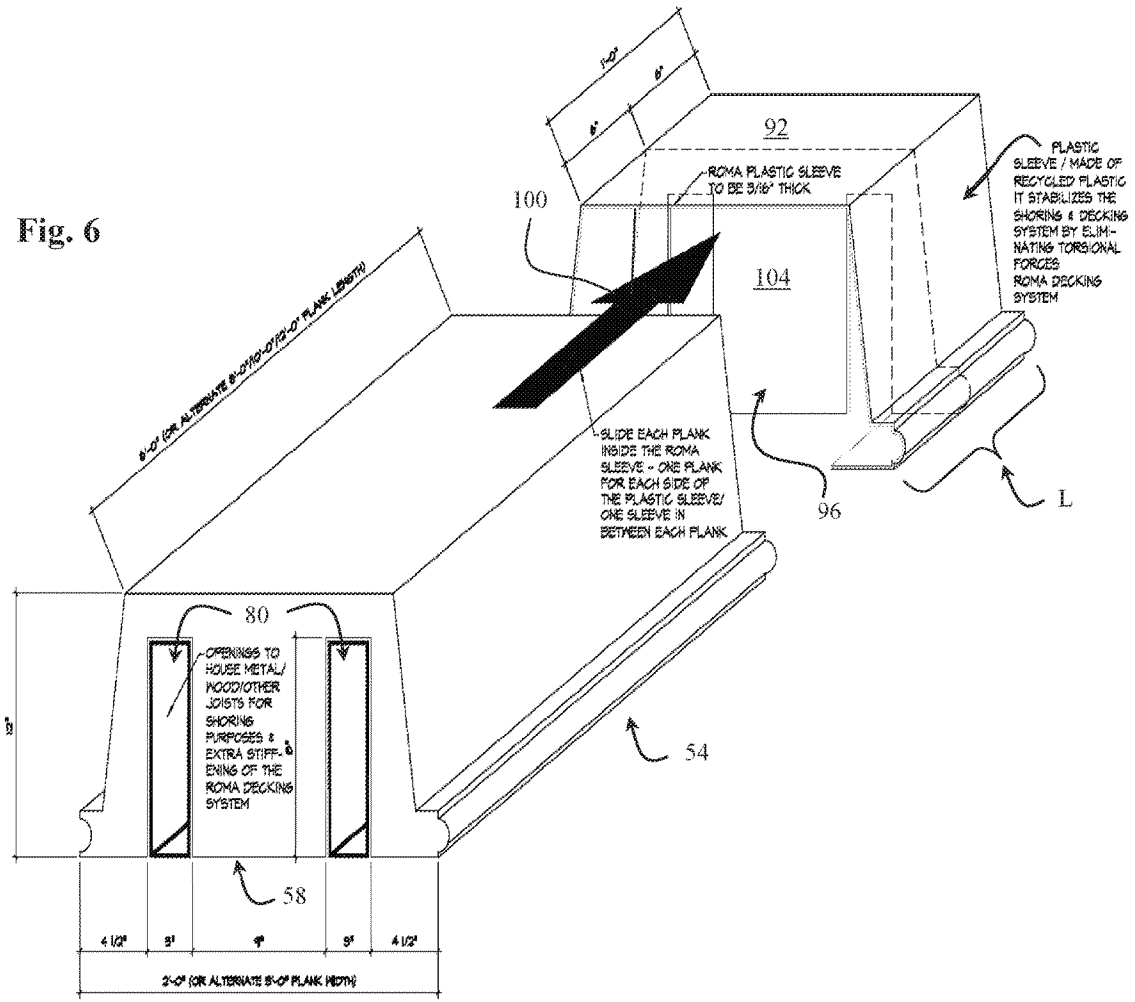
FIG. 6 shows an embodiment of the CFI panel 54 and a corresponding sleeve 92 which are used in providing the concrete form and insulative layer of the composite structure 50.

In one embodiment, for most of the CFI panels 54, approximately 6" of each CFI panel 54 end is contained within an adjacent panel receiving recesses 96 (as indicated in FIG. 6). As shown in FIG. 8, for pairs of temporary supports 84, there may be a continuous sequence of alternating CFI panels 54 and panel sleeves 92 so that the sequence extends the length of its temporary supports 84 between the supporting walls 108 (one of which is shown in FIG. 17). Such panel sleeves 92 can assist in mitigating torsional forces that may be developed inside the composite structure 50 being fabricated.
3. As indicated in FIG. 8, each row of CFI panels 54 is interlocked with the next one via a tongue-and-groove design (see FIGS. 6 and 8). Such interlocking improves the stability and speed of installation, eliminating unnecessary gaps at the time of pouring the concrete. This installation procedure is repeated per row of CFI panels 54 until the entire flooring surface is covered. The CFI panels 54 can be easily trimmed in those locations that require it, such as end pieces. Cutting is accomplished using common hand tools, such as saws or hot knifes. Because of the temporary supports 84 are an integral part of the of a composite structure 50, they can typically handle the usual job site loads, such as the weight of workers and fresh concrete. Temporary additional supports (not shown) may be provided underneath to shore the temporary supports 84 approximately every six to eight feet on center.
4. After all the CFI panels 54 are installed and the proper beneath shoring is in place, all the cables 110 and 114 are put in place. In particular, the cables 110 for the concrete T beams 76 are laid in their recesses (e.g., one cable per recess) such that each cable extends the length of the composite structure 50 and wherein (e.g., as shown in either FIGS. 3 and 5) the cable assumes one or more parabolic shapes. If a longer span of the composite structure 50 is desired, one or more transversal beams 88 may be required, following the same installation process, wherein at every cable 110, 114 intersection the crossing cables are spaced apart.

Figure 3:
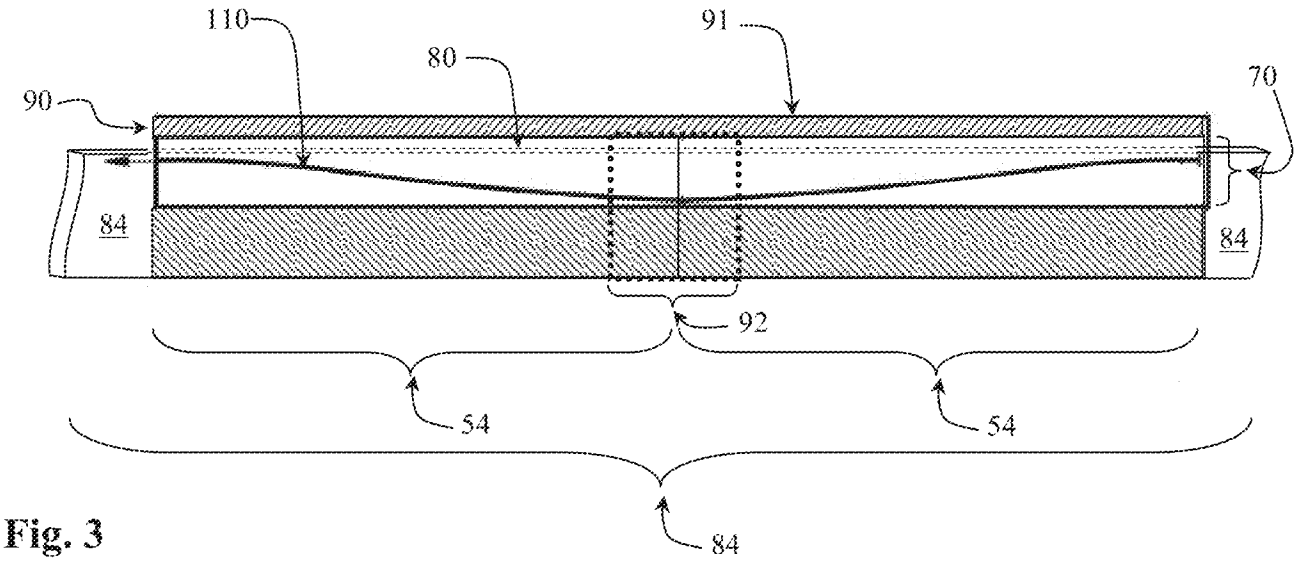
FIG. 3 shows a cross section of the composite structure 50 of FIG. 2, wherein this cross section is (i) determined by the cutting plane shown in FIG. 2 cutting through the composite structure 50 perpendicular to its planar top most load support surface 91 along the cutting line identified in FIG. 2, and (ii) viewed from the perspective of looking in the direction of arrows "A" shown in FIG. 2. Note that for greater clarity of presentation of the internal structure of the composite structure 50 embodiment, certain features are not cross hatched, shaded or not dashed.
Figure 12:
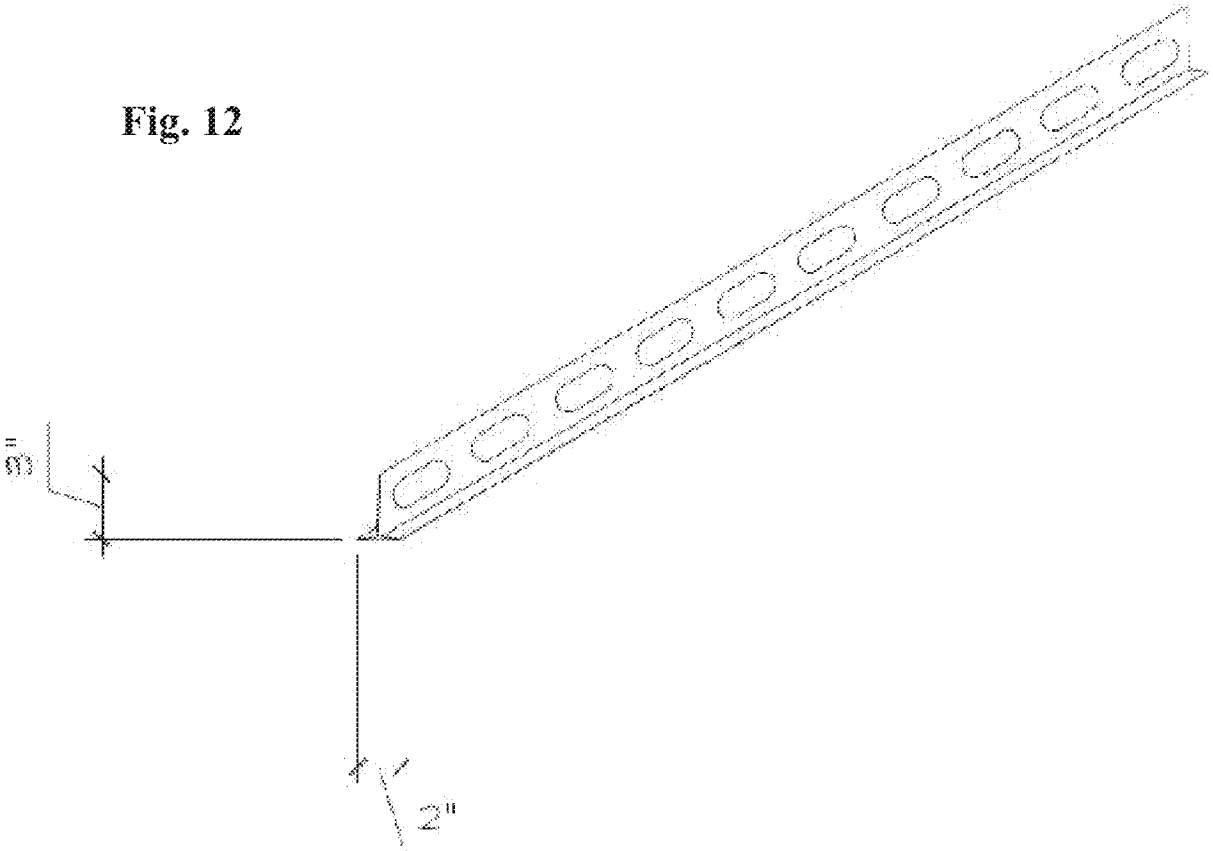
FIG. 12 shows an inverted T channel used for providing a uniform thickness of the upper most layer concrete of the composite structure 50.

Note that if the span of the flooring area is, for example, 30 feet, the cables 110 may be provided as shown in FIG. 3, with a low-point (about 1.5 inches from the bottom of the concrete T beam) at mid-span. If the desired span is, for example, 60 feet, a concrete post-tensioned transversal beam 88 may be required at the 30 feet span location (see FIG. 5) whose concrete is typically poured with the pouring of the concrete T beams 76 and the support surface slab. The form for each such transversal beam 88 is easily achieved by, e.g., a cutting channel 93 in the CFI panels 54 that is, e.g., 18 inches wide and is 6 inches deep across the widths of the CFI panels, wherein the channel 93 preferably extends perpendicularly to the recesses for the concrete T beams 76 as a straight path across the entire width of the assembled CFI panels 54 for the composite structure 50. Note by providing channels 93 in this manner, each transverse beam 88 is entirely concealed within the thickness of the composite structure 50. Thus, when finishing a ceiling on the side of the composite structure 50 that is opposite to the support surface 91, there is no need for dropping the ceiling level to accommodate traverse beam projections. Note that such channel cutting may be accomplished using common hand tools, such as saws or hot knifes.
5. With the cables 110 and 114 now placed inside the CFI panel recesses (which are spaced, in a configuration that induces lifting within the composite structure 50 in those areas of the composite structure where cracked moment capacities become very critical, see FIGS. 3 and 5), reinforcing bars are installed at each corner of each (any) transversal beam 88. In particular, this step includes installing enough #3 stirrup bars as required.
6. At this point, (any) utility conduits, channels, etc. are provided and/or formed within the lower most layer 56 of CFI panels 54, and such utility conduits, channels, etc. are then inspected by the proper authorities, the installers may start laying one or more inverted T channels (FIG. 16) and securing them to the top of the CFI panels 54 by applying a small amount of foam adhesive. Each inverted T channel may be an aluminum channel that is 3 inches in height, with a 2 inch wide base as shown in FIG. 12. Such inverted T channels come with openings in their vertical part, so that any additional structural cables, rebar, in-floor heating conduits and other items can be run across the concrete upper slab 90 without any obstructions. The inverted T channels are designed to aid the placement of the 3-inch top concrete slab 90 by assuring a uniform thickness throughout the entire support surface, thus eliminating the need of costly laser screeds.
7. After placement of all the inverted T channels (the placement of one on top of each CFI panel may be adequate), the installers complete the installation of the reinforcing bars for the concrete slab 90 (such reinforcing may be steel reinforcing bars and/or cables (to be tensioned).

Figure 15:
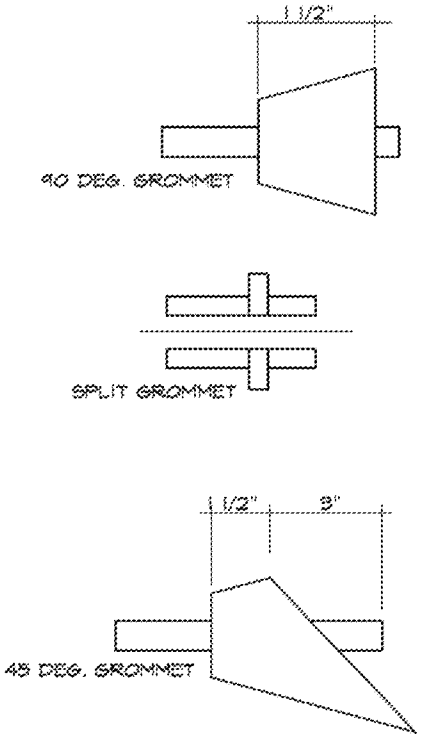
FIG. 15 shows an anchorage device for post tensioned cables.
Figure 15:
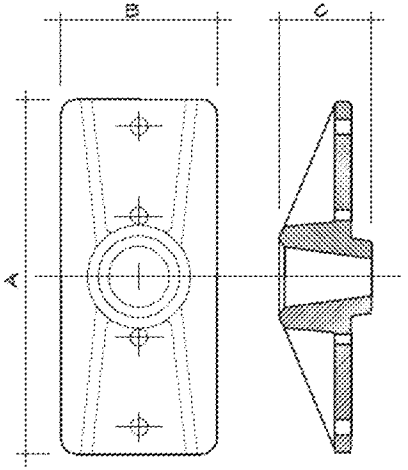

8. At this point pouring of the concrete can take place for fabricating the composite structure 50, including the (any) transversal beam(s) 88, the T beams 76 and the load support surface 91. In most embodiments, the concrete pouring starts at one side of the composite structure 50 being fabricated and progresses to the opposite side in a single pass. However, other techniques for pouring the concrete are within the scope of the present disclosure such as pouring a layer of concrete throughout the composite structure 50 being fabricated at a depth to provide the transverse beams 88 and/or the T beams 76, and then pouring another layer of concrete for the upper slab 90.
9. After the concrete has cured to a minimum predetermined compressive strength of, e.g., 3,000 psi, the cables 110 and 114 are then tensioned with special hydraulic jacks as one skilled in the art will understand. The cables 114 of the transverse beams 88 are tensioned first, followed by the cables 110 placed in the concrete T beams 76. Standard post-tension connections are used, as shown in FIGS. 13, 14 and 15.

Additional Embodiments

Figure 18:
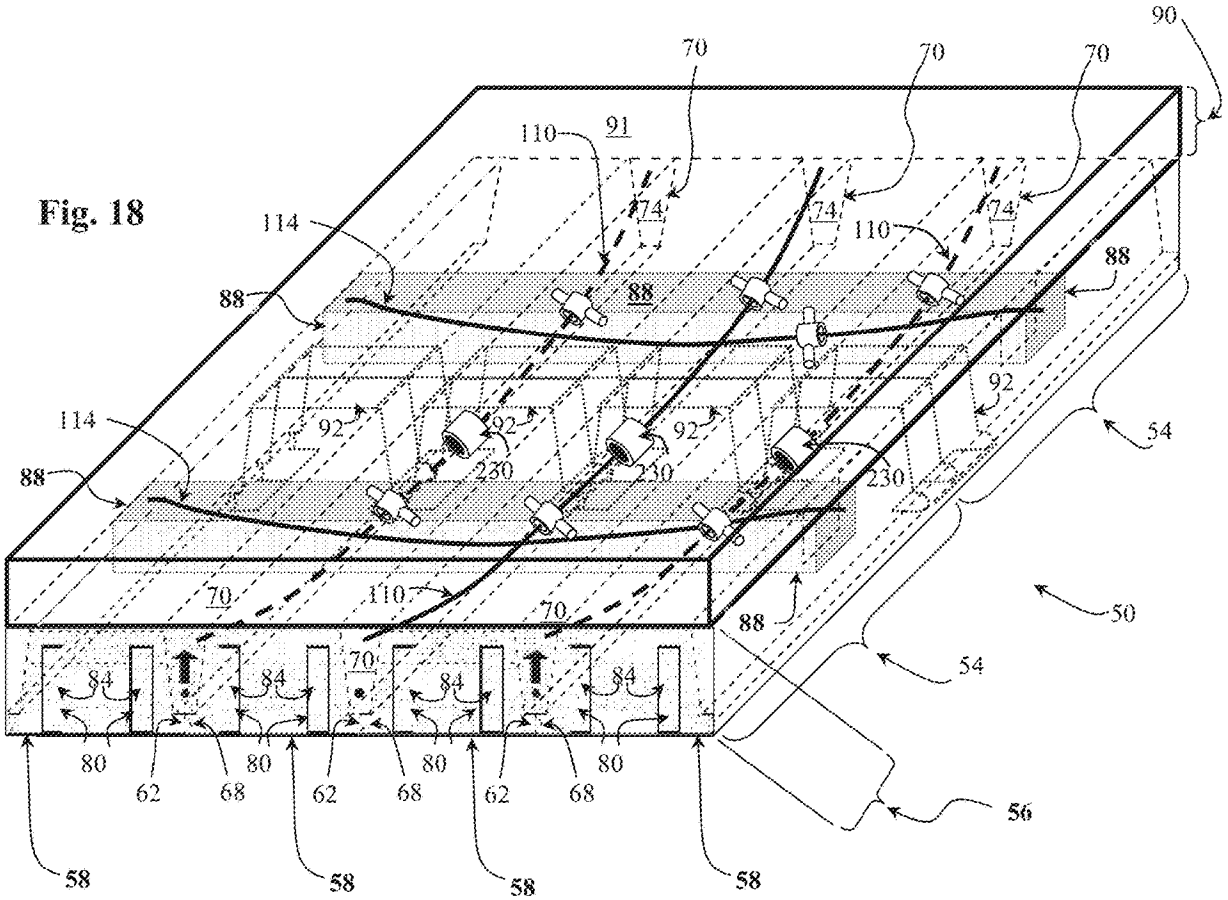
FIG. 18 shows another embodiment of the composite structure 50.

The above embodiments of the composite structures 50 may, in some embodiments, include other cable 110 and 114 arrangements. For example, instead of the cables 114 being positioned below the cables 110, at least one cable 110 may be positioned in the shape of a single parabolic arc between its end points so that this cable 110 transverses underneath each of the one or more cables 114. In this embodiment, the at least one cable 110 also provides only upwardly directed tension on the concrete to resist loads placed on the load support surface 91. In one embodiment (e.g., as shown in FIG. 18), the dashed cables 110 extend underneath the cables 114. However, the non-dashed cable 110 may cross above or below the cables 114 depending on the spacing between the cables 114 and this cable 110. In particular, in one embodiment, it is preferred to have, e.g., at least 1.5 to 3 inches separating the cables 110 and 114 at their crossings, and more preferably about 2 inches. In one embodiment, the curvature of the parabolic arc of one or more of the cables 110 and 114 may be adjusted so that where such cables cross there is a predetermined spacing (to be filled with concrete) therebetween. Thus, e.g., the non-dashed cable 110 in FIG. 18 may have its length adjusted so that it hangs above the cables 114.

Figure 19:
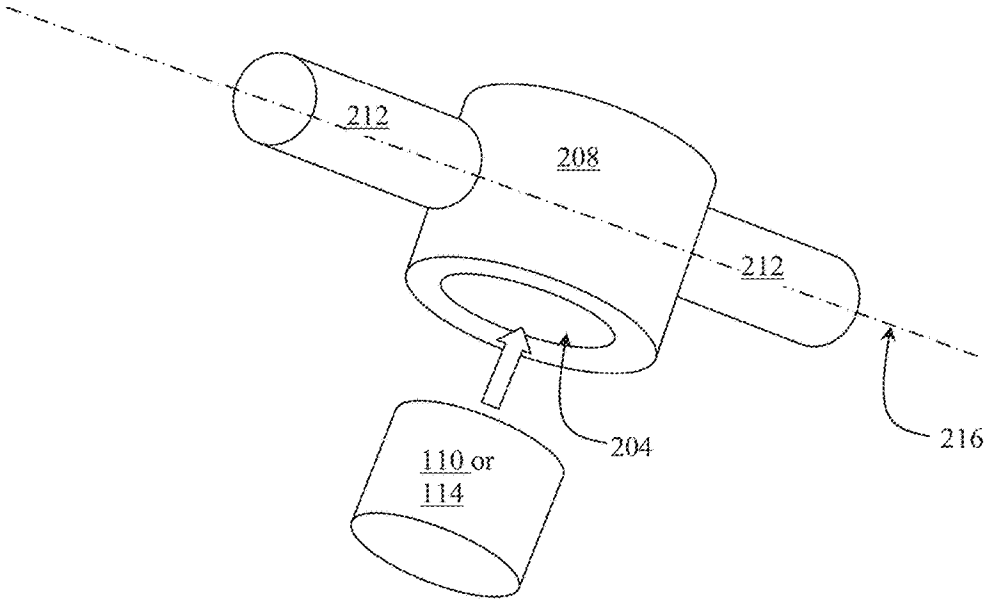
FIG. 19 shows an embodiment of a plurality of tension load distributer 208 embedded in the concrete of the composite structure 50.

In one embodiment, one or more of the cables 110 and/or 114 may be threaded into eyes 204 of one or more load distributers 208 (FIG. 19), wherein each load distributer includes at least one (and preferably at least two) projection 212 for distributing the upward pressure of the cable (110 or 114) over a greater internal area of the concrete. In FIG. 19, such projections 212 are shown as cylindrical, and such projections may be oriented in the concrete so that the axis 216 is generally parallel to the load support surface 91 for thereby distributing the upward directed force/pressure of the tensioned cables 110 and/or 114 over a wider portion of the concrete. Note; however, other shapes for the projections 212 are also within the scope of the present disclosure such as paddle shaped, elliptical or rectangular cross sections for the projections, wherein the wider extent of each such cross section is also substantially parallel to the load support surface 91.

In one embodiment, the one or more cables 110 and/or 114 may include components 230 thereon (FIGS. 18 and 19), wherein such components may include moisture sensors (not shown) for detecting problematic concentrations of moisture within the composite structure 50 which could lead to, e.g., premature composite structure 50 failure. In one embodiment, the power to activate and operate such components 230 may be obtained in a manner substantially similar to the passive radio techniques for detecting and identifying RFID tags, wherein radio energy from a remote device (e.g., a radio transmitter) above the load support surface 91 is utilized by the components 230 to activate and transmit a reading of the moisture content at the sensor. In another embodiment, the components may include cable tension detectors for detecting a reduction in the tension in a cable 110 or 114 to which the component 230 is attached.

In one embodiment, the cables 110 and 114 may be substantially straight but not highly tensioned as the concrete is poured, wherein the cables 110 and 114 are spaced apart at their crossings by, e.g., about at least 2 to 3 inches. In one embodiment, the cables 110 are diagonally positioned across the length of the composite structure, wherein such cables alternate in their diagonal orientation such that, e.g., a first cable 110 extends upwardly (e.g., from a first end of the length of the composite structure 50 to the second end) and the adjacent cable(s) 110 extend downwardly from the first end of the length of the composite structure 50 to the second end. In one embodiment, the cables 114 may be substantially horizontal with the load support surface 91. Thus, the cables 110 and 114 may be woven together across both the width and length of the composite structure 50. In another embodiment, such diagonalization of cables can be provided to configure the cables 114 instead of or in addition to the cables 110.

The foregoing discussion of the invention has been presented for purposes of illustration and description. Further, the description is not intended to limit the invention to the form disclosed herein. Consequently, variation and modification commiserate with the above teachings, within the skill and knowledge of the relevant art, are within the scope of the present invention. The embodiment described hereinabove is further intended to explain the best mode presently known of practicing the invention and to enable others skilled in the art to utilize the invention as such, or in other embodiments, and with the various modifications required by their particular application or uses of the invention.

What is claimed is:

1. A composite structure, comprising:

a plurality of cables;

a concrete member cured about the cables, wherein the cables are tensioned within the concrete member for inducing a strength to the concrete member;

at least one sensing component on a cable of the plurality of cables, wherein the sensing component is configured to: (a) sense at least one condition in the concrete member when the concrete member is cured, and (b) wirelessly communicate a measurement of the condition in the concrete member; and a tension load distribution member attached or connected to at least one of the cables to distribute a tension on the at least one cable over a greater area of an interior of the concrete member than the at least one cable would provide without the tension load distribution member;

wherein the concrete member is poured about the tension load distribution member for embedding the tension load distribution member in the concrete member such that for each portion of the at least one cable, which contacts the tension load distribution member, the portion is entirely surrounded by concrete of the concrete member.

2. The composite structure of claim 1, wherein the sensing component and the tension load distribution member are on a same one of the cables.

3. The composite structure of claim 1, wherein the at least one cable is threaded through an eye of the tension load distribution member.

4. The composite structure of claim 1, wherein the tension load distribution member includes at least one projection for distributing the tension over the greater area of the interior of the concrete member.

5. The composite structure of claim 4, wherein the at least one projection is oriented parallel to a load support surface of the concrete member.

6. The composite structure of claim 4, wherein a cross section of the at least one projection is one of cylindrical, paddle, elliptical, or rectangular shaped.

7. The composite structure of claim 1, wherein power to activate the sensing component is obtained by a passive radio technique.

8. The composite structure of claim 1, wherein the condition includes a reduction of the tension on the cable and wherein the at least one sensing component includes a sensing component able to detect the reduction of the tension on the cable.

9. The composite structure of claim 1, wherein the plurality of cables comprises two sets of cables, wherein the two sets of cables run substantially perpendicular to each other, and wherein, for each set of cables, the cables of the set run substantially parallel to other cables of the respective set of cables.

10. The composite structure of claim 9, wherein when viewed from at least one position, the cables are substantially straight, and wherein, two cables, one each from the two sets of cables, are spaced apart at a crossing of the two cables.

11. The composite structure of claim 9, wherein at least one set of the cables of the two sets of cables is diagonally positioned across a length of the composite structure.

12. The composite structure of claim 9, wherein at least one set of cables of the two sets of cables is positioned substantially parallel to a load support surface of the concrete member.

13. A composite structure, comprising:

a plurality of cables;

a concrete member cured about the cables, wherein the cables are tensioned;

at least one sensing component on a cable of the plurality of cables, wherein the sensing component is fully surrounded by concrete of the concrete member, wherein the sensing component is configured to: (a) sense moisture in the concrete member when the concrete member is cured and (b) wirelessly communicate a measurement of the moisture in the concrete member, wherein power to activate the sensing component is obtained by a passive radio technique, and wherein the measurement is transmitted wirelessly by the sensing component; and a tension load distribution member attached or connected to at least one of the cables to distribute a tension on the at least one cable over a greater area of an interior of the concrete member than the at least one cable would provide without the tension load distribution member;

wherein the concrete member is poured about the tension load distribution member for embedding the tension load distribution member in the concrete member such that for each portion of the at least one cable, which contacts the tension load distribution member, the portion is entirely surrounded by concrete of the concrete member.

14. The composite structure of claim 1, wherein the measurement is transmitted wirelessly by the sensing component.

15. The composite structure of claim 1, wherein the condition includes moisture in the concrete member.

16. The composite structure of claim 1, wherein the load distribution member includes extents away of the at least one cable for at least a diameter of the at least one cable.

17. The composite structure of claim 1, wherein the load distribution member increases a resistance of a force on the concrete member transverse to a length of the at least one cable.

18. A composite structure, comprising:

a plurality of cables;

a concrete member cured about the cables, wherein the cables are tensioned within the concrete member for inducing a strength to the concrete member;

at least one sensing component on a cable of the plurality of cables, wherein the sensing component is configured to: (a) sense at least one condition in the concrete member when the concrete member is cured, and (b) communicate a measurement of the condition in the concrete member; and a tension load distribution member attached or connected to at least one of the cables to distribute a tension on the at least one cable over a greater area of an interior of the concrete member than the at least one cable would provide without the tension load distribution member;

wherein the concrete member is poured about the tension load distribution member for embedding the tension load distribution member in the concrete member such that for each portion of the at least one cable, which contacts the tension load distribution member, the portion is entirely surrounded by concrete of the concrete member.

* * * * *